US011200852B2

(12) United States Patent
Shin et al.

(10) Patent No.: US 11,200,852 B2
(45) Date of Patent: Dec. 14, 2021

(54) DISPLAY DEVICE AND METHOD OF DRIVING THE SAME

(71) Applicant: Samsung Display Co., Ltd., Yongin-si (KR)

(72) Inventors: Ok Kwon Shin, Yongin-si (KR); Bong Ho Bae, Yongin-si (KR); Chong Guk Lee, Yongin-si (KR); Myeong Bin Lim, Yongin-si (KR); Hyun Ho Lim, Yongin-si (KR); Se Hui Jang, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 108 days.

(21) Appl. No.: 16/533,484

(22) Filed: Aug. 6, 2019

(65) Prior Publication Data

US 2020/0184900 A1 Jun. 11, 2020

(30) Foreign Application Priority Data

Dec. 7, 2018 (KR) ..... 10-2018-0157117

(51) Int. Cl.
*G09G 3/3275* (2016.01)
*G09G 3/3233* (2016.01)
(Continued)

(52) U.S. Cl.
CPC ..... *G09G 3/3275* (2013.01); *G09G 3/2003* (2013.01); *G09G 3/32* (2013.01);
(Continued)

(58) Field of Classification Search
CPC .. G09G 3/3275; G09G 3/2003; G09G 3/3233; G09G 3/32; G09G 2370/00;
(Continued)

(56) References Cited

U.S. PATENT DOCUMENTS 7,800,573 B2 9/2010 Woo et al.
7,977,125 B2 7/2011 Song
(Continued)

FOREIGN PATENT DOCUMENTS

KR 10-0688538 B1 3/2007
KR 10-2016-0092530 A 8/2016

*Primary Examiner* — Patrick N Edouard
*Assistant Examiner* — Joseph P Fox
(74) *Attorney, Agent, or Firm* — Lewis Roca Rothgerber Christie LLP

(57) ABSTRACT

Provided herein may be a display device, which may include a display panel including a pixel column having a first pixel and a second pixel, a first data line coupled to the first pixel, and a second data line coupled to the second pixel, a data driver configured to output a data signal for the pixel column to an output line, a signal distribution circuit configured to receive the data signal through the output line, and to alternately transmit the data signal to the first data line and to the second data line, and a signal transmission circuit coupled between the data driver and the output line, and configured to transmit the data signal to the output line during a first period and a second period, and to block transmission of the data signal during a third period that is between the first period and the second period.

20 Claims, 17 Drawing Sheets

(51) Int. Cl.
*G09G 3/20* (2006.01)
*G09G 3/32* (2016.01)

(52) U.S. Cl.
CPC ... *G09G 3/3233* (2013.01); *G09G 2300/0452* (2013.01); *G09G 2310/0243* (2013.01); *G09G 2330/021* (2013.01); *G09G 2370/00* (2013.01)

(58) Field of Classification Search
CPC ... G09G 2300/0452; G09G 2310/0243; G09G 2300/0819; G09G 2300/0861; G09G 2300/0842; G09G 2330/021; G09G 3/3291; G09G 2310/0297; G09G 3/20; G09G 3/2074
See application file for complete search history.

(56) References Cited

U.S. PATENT DOCUMENTS

| | | | | |
|---|---|---|---|---|
| 9,859,350 | B2 | 1/2018 | Li et al. | |
| 2012/0313903 | A1* | 12/2012 | Pyon | G09G 3/32 345/204 |
| 2016/0217744 | A1 | 7/2016 | Song et al. | |
| 2017/0004759 | A1* | 1/2017 | Yin | G09G 3/2092 |
| 2017/0345384 | A1* | 11/2017 | Ma | G09G 3/20 |

* cited by examiner

DISPLAY DEVICE AND METHOD OF DRIVING THE SAME

CROSS-REFERENCE TO RELATED APPLICATION

This application claims priority to, and the benefit of, Korean patent application number 10-2018-0157117 filed on Dec. 7, 2018, the entire disclosure of which is incorporated herein in its entirety by reference.

BACKGROUND

1. Field

Various embodiments of the present disclosure relate to a display device, and to a method of driving the display device.

2. Related Art

A display device displays an image on a display panel using externally applied control signals. The display device includes a display panel provided with a plurality of pixels arranged in a matrix form, a display panel drive circuit, and a power supply circuit. The pixels may emit light with luminance corresponding to data signals applied through the display panel drive circuit.

SUMMARY

The area of a display device may be increased, or high-frequency driving may be used, to improve the image quality of the display device (e.g., a driving scheme may change from 60 Hz driving to 120 Hz driving). Accordingly, the time suitable to charge a data signal in each pixel may be reduced, and thus, power consumption may be increased due to high-frequency driving or the like.

Various embodiments of the present disclosure are directed to a display device, which can reduce power consumption while sufficiently securing the time for charging a data signal in each pixel, and are directed to a method of driving the display device.

An embodiment of the present disclosure may provide for a display device. The display device may include a display panel including a pixel column having a first pixel and a second pixel, a first data line coupled to the first pixel, and a second data line coupled to the second pixel, a data driver configured to output a data signal for the pixel column to an output line, a signal distribution circuit configured to receive the data signal through the output line, and to alternately transmit the data signal to the first data line and to the second data line, and a signal transmission circuit coupled between the data driver and the output line, and configured to transmit the data signal to the output line during a first period and a second period, and to block transmission of the data signal during a third period that is between the first period and the second period.

The signal distribution circuit may couple the output line to one of the first data line and the second data line during the third period, wherein a remaining one of the first data line and the second data line is disconnected from the output line during the third period.

The signal distribution circuit may be configured to transmit the data signal to the first data line during the first period, and to transmit the data signal to the second data line during the second period.

The signal distribution circuit may include a first switching element coupled between the output line and the first data line, and a second switching element coupled between the output line and the second data line, wherein one of the first switching element and the second switching element is turned on during the third period, and wherein a remaining one of the first switching element and the second switching element remains turned off during the third period.

The remaining one of the first switching element and the second switching element may be turned off during the first period, wherein the first period is a period previous to the third period.

After the remaining one of the first switching element and the second switching element has been turned off, the one of the first switching element and the second switching element may be turned on.

The signal transmission circuit may include a third switching element coupled between the data driver and the output line, wherein the third switching element is turned off at a start point of the third period, and is turned on at an end point of the third period, in response to an impedance control signal provided from the data driver.

A time point at which the one of the first switching element and the second switching element is turned on may be closer to the start point of the third period than to the end point of the third period.

A time point at which the one of the first switching element and the second switching element is turned on may be closer to the end point of the third period than to the start point of the third period.

The second pixel may be adjacent to the first pixel, wherein the first pixel is configured to emit light in a first color, wherein the second pixel is configured to emit light in a second color that is different from the first color, and wherein the first pixel and the second pixel are alternately and repeatedly arranged in the pixel column.

An embodiment of the present disclosure may provide for a method of driving a display device. The method may include generating, by a data driver, a data signal for a first pixel and a second pixel in a display panel, providing the data signal to a first data line coupled to the first pixel through a signal distribution circuit, blocking an output of the data driver to the signal distribution circuit, and providing the data signal to a second data line coupled to the second pixel through the signal distribution circuit.

The first pixel and the second pixel may be in a single pixel column, wherein the second pixel is adjacent to the first pixel, wherein the first pixel emits light in a first color, and wherein the second pixel emits light in a second color that is different from the first color.

Blocking the output of the data driver may include increasing an impedance between the data driver and the signal distribution circuit through a signal transmission circuit coupled between the data driver and the signal distribution circuit.

The signal distribution circuit may include a first switching element coupled between an output line and the first data line, and a second switching element coupled between the output line and the second data line, wherein the signal transmission circuit includes a third switching element coupled between the data driver and the output line, and wherein transmitting the data signal to the first data line includes turning on the first switching element in a state in which the second switching element is turned off, and turning on the third switching element.

Blocking the output of the data driver may include turning off the third switching element.

The third switching element may be turned off after turning off the first switching element.

A time point at which the first switching element is turned on may be closer to a time point at which the third switching element is turned off than to a time point at which the third switching element is turned on.

A time point at which the first switching element is turned on may be closer to a time point at which the third switching element is turned on than to a time point at which the third switching element is turned off.

The first pixel and the second pixel may be in a single pixel row.

The signal distribution circuit may include a first switching element coupled between an output line and the first data line, and a second switching element coupled between the output line and the second data line, wherein a third switching element is coupled between the data driver and the output line, and wherein transmitting the data signal to the first data line includes turning on the first switching element in a state in which the second switching element is turned off, and turning on the third switching element.

The display device according to the present disclosure may supply data signals to pixels in a pixel column using a signal distribution circuit and a pair of data lines, thus more sufficiently securing the time for charging the data signals in the pixels.

Further, the display device may reduce power consumption by blocking the output of a data driver to a signal distribution circuit while the signal distribution circuit is switching a data line to which a data signal is supplied.

DETAILED DESCRIPTION

Figure 1A:
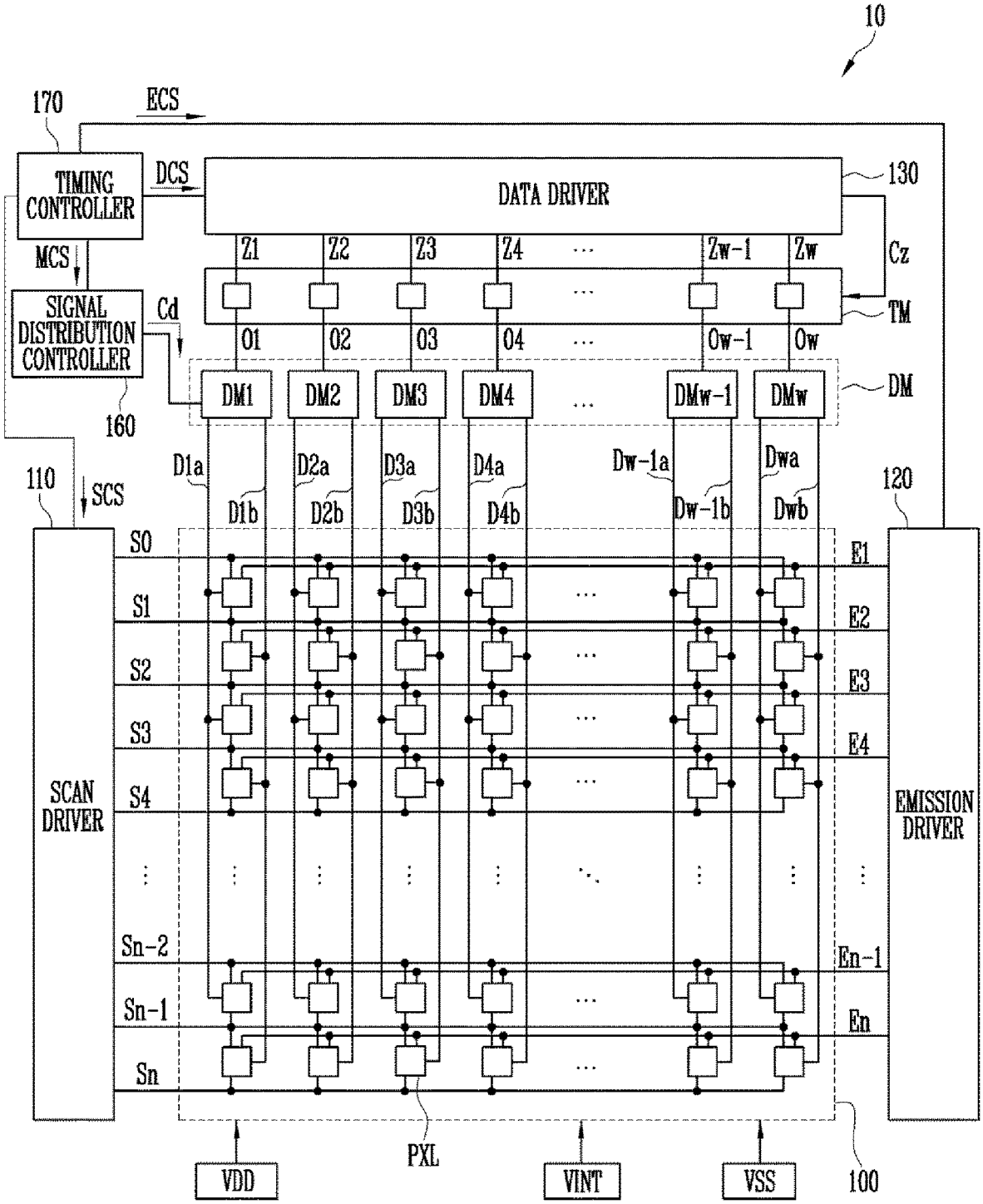
FIGS. 1A and 1B are diagrams illustrating a display device according to embodiments of the present disclosure.

Features of the inventive concept and methods of accomplishing the same may be understood more readily by reference to the detailed description of embodiments and the accompanying drawings. Hereinafter, embodiments will be described in more detail with reference to the accompanying drawings. The described embodiments, however, may be embodied in various different forms, and should not be construed as being limited to only the illustrated embodiments herein. Rather, these embodiments are provided as examples so that this disclosure will be thorough and complete, and will fully convey the aspects and features of the present inventive concept to those skilled in the art. Accordingly, processes, elements, and techniques that are not necessary to those having ordinary skill in the art for a complete understanding of the aspects and features of the present inventive concept may not be described. Unless otherwise noted, like reference numerals denote like elements throughout the attached drawings and the written description, and thus, descriptions thereof will not be repeated. Further, parts not related to the description of the embodiments might not be shown to make the description clear. In the drawings, the relative sizes of elements, layers, and regions may be exaggerated for clarity.

Various embodiments are described herein with reference to sectional illustrations that are schematic illustrations of embodiments and/or intermediate structures. As such, variations from the shapes of the illustrations as a result, for example, of manufacturing techniques and/or tolerances, are to be expected. Further, specific structural or functional descriptions disclosed herein are merely illustrative for the purpose of describing embodiments according to the concept of the present disclosure. Thus, embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting. Additionally, as those skilled in the art would realize, the described embodiments may be modified in various different ways, all without departing from the spirit or scope of the present disclosure.

In the detailed description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. Similarly, when a first part is described as being arranged "on" a second part, this indicates that the first part is arranged at an upper side or a lower side of the second part without the limitation to the upper side thereof on the basis of the gravity direction.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

For the purposes of this disclosure, expressions such as "at least one of," when preceding a list of elements, modify the entire list of elements and do not modify the individual elements of the list. For example, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value. Further, the use of "may" when describing embodiments of the present disclosure refers to "one or more embodiments of the present disclosure."

When a certain embodiment may be implemented differently, a specific process order may be performed differently from the described order. For example, two consecutively described processes may be performed substantially at the same time or performed in an order opposite to the described order.

Also, any numerical range disclosed and/or recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein, and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein. All such ranges are intended to be inherently described in this specification such that amending to expressly recite any such subranges would comply with the requirements of 35 U.S.C. § 112(a) and 35 U.S.C. § 132(a).

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present disclosure.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 1B:
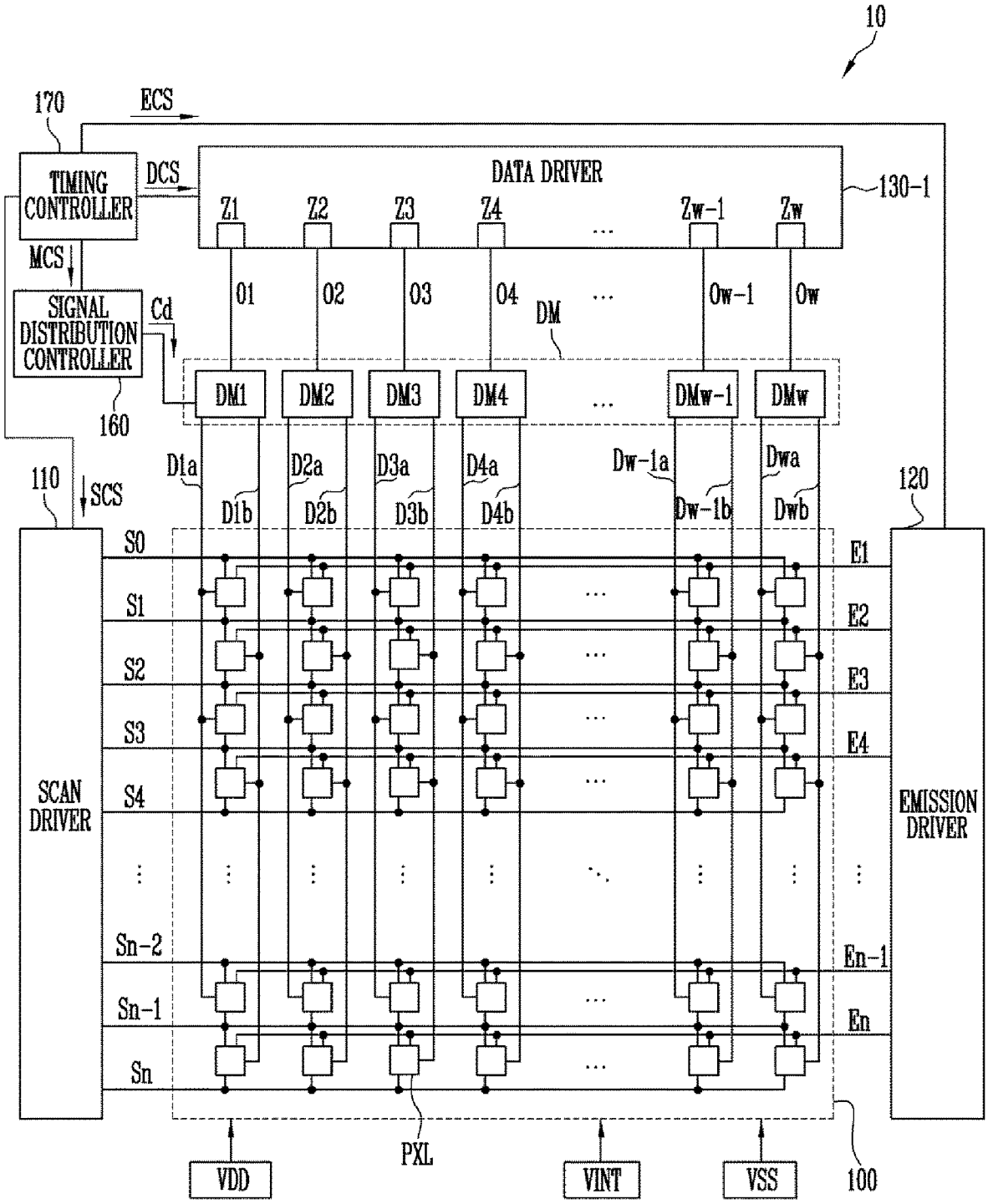

FIGS. 1A and 1B are diagrams illustrating a display device according to embodiments of the present disclosure.

Referring to FIG. 1A, a display device 10 may include a display panel 100, a scan driver 110, an emission driver 120, a data driver 130, a signal distributor (or a signal distribution circuit or a demultiplexer) DM, a signal transmitter (or a signal transmission circuit) TM, a signal distribution controller 160, and a timing controller 170.

The display panel 100 may include scan lines S0 to Sn (where n is a positive integer), emission lines E1 to En, data lines D1*a*, D1*b*, D2*a*, D2*b*, . . . , Dwa, and Dwb (where w is a positive integer), and pixels PXL. The pixels PXL may be arranged in regions partitioned by the scan lines S0 to Sn, the emission lines E1 to En, and the data lines D1*a* to Dwb.

Each of the pixels PXL may be coupled to at least one of the scan lines S0 to Sn, one of the emission lines E1 to En, and one of the data lines D1*a* to Dwb.

In embodiments, pixels PXL included in a single pixel column may be alternately coupled to a pair of data lines. For example, pixels included in odd-numbered rows (or first pixels), among pixels PXL included in a first column, may be coupled to a first odd-numbered data line D1*a* (or a first data line), and pixels included in even-numbered rows (or second pixels), among the pixels PXL included in the first column, may be coupled to a first even-numbered data line D1*b* (or a second data line). Detailed coupling relationships between the pixels PXL and the data lines D1*a* to Dwb will be described later with reference to FIGS. 2A and 2B.

Each of the pixels PXL may emit light with luminance corresponding to a data signal provided through one of the data lines D1*a* to Dwb in response to a scan signal provided through at least one of the scan lines S0 to Sn and an emission signal provided through one of the emission lines E1 to En. The detailed configuration and operation of each of the pixels PXL will be described in detail later with reference to FIG. 3.

The scan driver 110 may generate scan signals in response to a scan control signal SCS, and may sequentially provide the scan signals to the scan lines S0 to Sn. Here, the scan control signal SCS may include an initiation signal (or a scan initiation signal), clock signals (or scan clock signals), etc., and may be provided from the timing controller 170. For example, the scan driver 110 may sequentially generate and output the scan signals corresponding to the initiation signal using the clock signals. The scan driver 110 may include a shift register. The scan driver 110 may be formed on the display panel 100, or may be implemented as an IC and coupled to the display panel 100 in the form of a tape carrier package.

The emission driver 120 may generate emission signals in response to an emission control signal ECS, and may provide the emission signals to the emission lines E1 to En. Here, the emission control signal ECS may include an emission initiation signal, emission clock signals, etc. For example, the emission driver 120 may sequentially generate and output the emission signals corresponding to the emission initiation signal using the emission clock signals. The emission driver 120 may be formed on the display panel 100, or may be implemented as an IC and coupled to the display panel 100 in the form of a tape carrier package.

The data driver 130 may generate data signals based on image data provided from the timing controller 170, and may output the data signals through output terminals. The data driver 130 may sequentially generate data signals corresponding to the pixels PXL included in a single pixel column, and may sequentially output the data signals through an output terminal (or one of output lines O1 to Ow) corresponding to the single pixel column. The data driver 130 may be coupled to the display panel 100 in the form of a tape carrier package (TCP) or may be formed on the display panel 100.

The signal distributor DM may receive the data signals through input terminals thereof (or the output lines O1 to Ow), and may distribute the data signals to the data lines D1*a* to Dwb in response to a driving signal Cd. Here, the driving signal Cd may be provided from the signal distribution controller 160.

The signal distributor DM may include signal distribution circuits DM1 to DMw. Each of the signal distribution circuits DM1 to DMw may be coupled to a pair of data lines. For example, the first signal distribution circuit DM1 may be coupled to the first odd-numbered data line D1*a* (or the first data line) and the first even-numbered data line D1*b* (or the second data line). In this case, the first signal distribution circuit DM1 may alternately transmit data signals, which are received through a first input terminal (or the first output line O1), to the first odd-numbered data line D1*a* (or the first data line) and to the first even-numbered data line D1*b* (or the second data line).

Similarly, the w-th signal distribution circuit DMw may be coupled to a w-th odd-numbered data line Dwa and a w-th even-numbered data line Dwb, and may alternately transmit the data signals, which are received through a w-th input terminal (or from the w-th output line Ow), to the w-th odd-numbered data line Dwa and the w-th even-numbered data line Dwb.

The signal distributor DM may be formed on the display panel 100, but is not limited thereto. The detailed configuration of the signal distributor DM will be described later with reference to FIG. 2A.

The signal transmitter TM may be coupled between the output terminals of the data driver 130 and the input terminals of the signal distributor DM, and may transmit the data signals from the data driver 130 to the signal distributor DM, or may block the transmission of the data signals in response to an impedance control signal Cz. Here, the impedance control signal Cz may be provided from the data driver 130, and may be, for example, a reference clock signal that is also used to sequentially generate the data signals.

In embodiments, the signal transmitter TM may transmit data signals to the signal distributor DM during signal transmission intervals (or signal-transmission periods), and may block the transmission of data signals during a signal-blocking interval (or a signal-blocking period). For example, the signal transmitter TM may increase impedance between the signal transmitter TM and the signal distributor DM, or may electrically disconnect (or isolate) the signal transmitter TM from the signal distributor DM during the signal-blocking period.

When the signal distributor DM performs a switchover (or a switching) operation (e.g., when the first signal distribution circuit DM1 switches over a data signal transmission target from the first data line to the second data line) during the signal-blocking period, the signal transmitter TM and the signal distributor DM are electrically disconnected, thus mitigating an increase in power consumption by the data driver 130 attributable to the switchover operation of the signal distributor DM.

The signal transmitter TM may include signal transmission circuits Z1 to Zw. Each of the signal transmission circuits Z1 to Zw may be coupled to one of the output terminals of the data driver 130 and one of the input terminals of the signal distributor DM (or one of the output lines O1 to Ow). For example, the first signal transmission circuit Z1 may be coupled to the first output terminal of the data driver 130, and may be coupled to the first input terminal (or the first signal distribution circuit DM1) of the signal distributor DM through the first output line O1. Similarly, the w-th signal transmission circuit Zw may be coupled to the w-th output terminal of the data driver 130, and may be coupled to the w-th input terminal (or the w-th signal distribution circuit DMw) of the signal distributor DM through the w-th output line Ow.

The signal transmitter TM may be formed on the display panel 100, but is not limited thereto. The detailed configuration of the signal transmitter TM will be described later with reference to FIG. 2A.

The signal distribution controller 160 may control the operation of the signal distributor DM via the driving signal Cd. The signal distribution controller 160 may receive a distribution control signal MCS supplied from the timing controller 170, and may generate the driving signal Cd corresponding to the distribution control signal MCS.

The timing controller 170 may receive input image data and a control signal from an external system (e.g., a graphic processor), may generate the scan control signal SCS, the emission control signal ECS, a data control signal DCS, and the distribution control signal MCS based on the control signal, and may generate image data by converting the input image data.

Meanwhile, first and second supply voltages VDD and VSS and an initialization voltage VINT may be provided to the display panel 100. The supply voltages VDD and VSS are voltages suitable for operation of the pixels PXL, wherein the first supply voltage VDD may have a voltage level that is higher than that of the second supply voltage VSS. The initialization voltage VINT may be used to initialize previous data signals stored in the pixels PXL.

As described above with reference to FIG. 1A, the display device 10 may transmit data signals to the pixels PXL included in a single pixel column through the signal distributor DM and a pair of data lines (e.g., first and second data lines), thus more sufficiently securing the time for writing the data signals to the pixels PXL. Further, the display device 10 may block the output of the data driver 130, or may increase impedance between the data driver 130 and the signal distributor DM, through the signal transmitter TM during a signal-blocking period, thus mitigating an increase in power consumption of the data driver 130 attributable to the switchover operation of the signal distributor DM.

Meanwhile, although the scan driver 110, the emission driver 120, the data driver 130, the signal distributor DM, the signal transmitter TM, the signal distribution controller 160, and the timing controller 170 have been individually illustrated in FIG. 1A for convenience of description, some of the components may be integrated with others. For example, as illustrated in FIG. 1B, the signal transmitter TM may be included in the data driver 130-1.

Figure 2A:
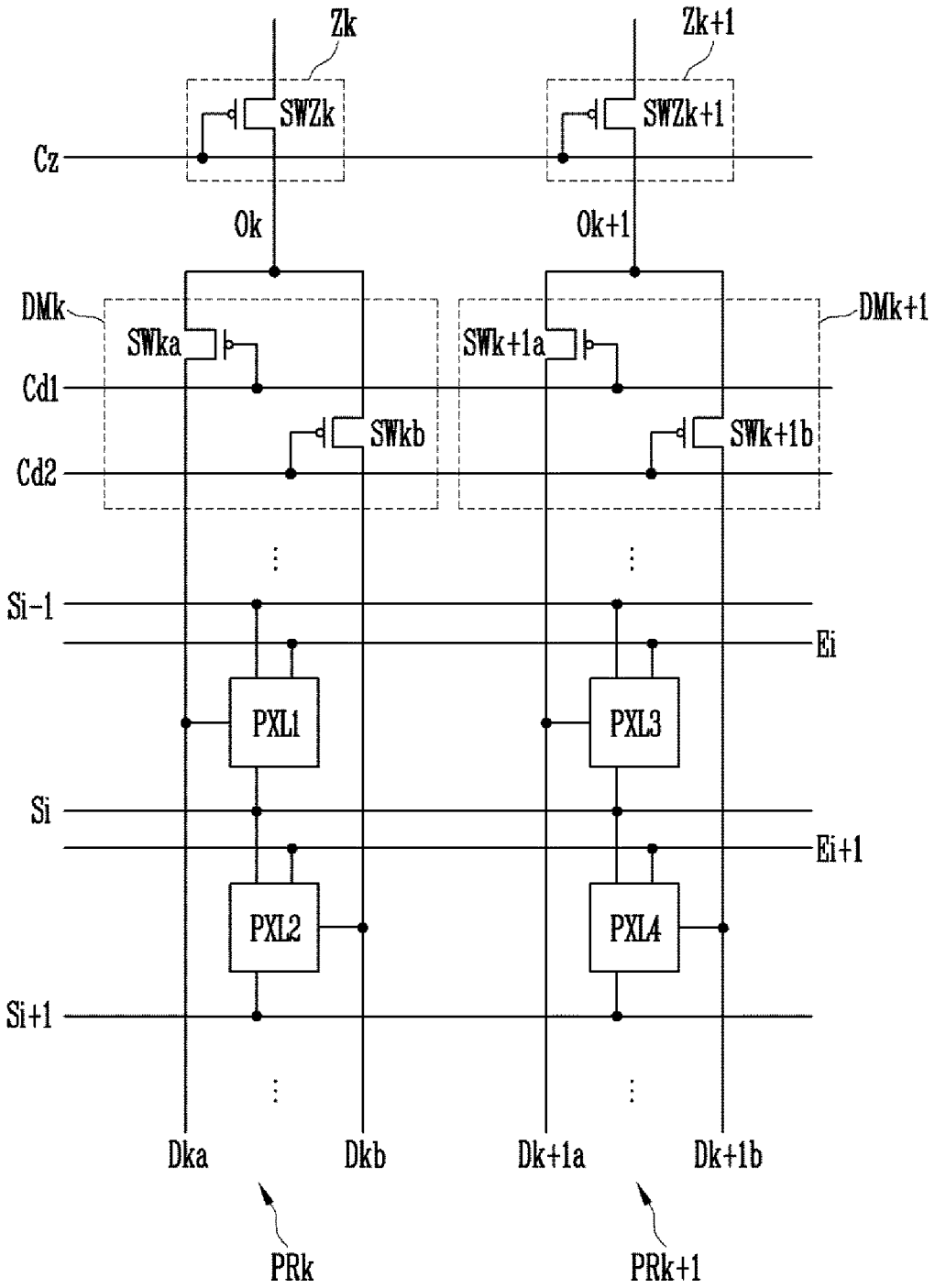
FIGS. 2A and 2B are circuit diagrams illustrating examples of coupling relationships between pixels and data lines, included in the display device of FIG. 1A.
Figure 2B:
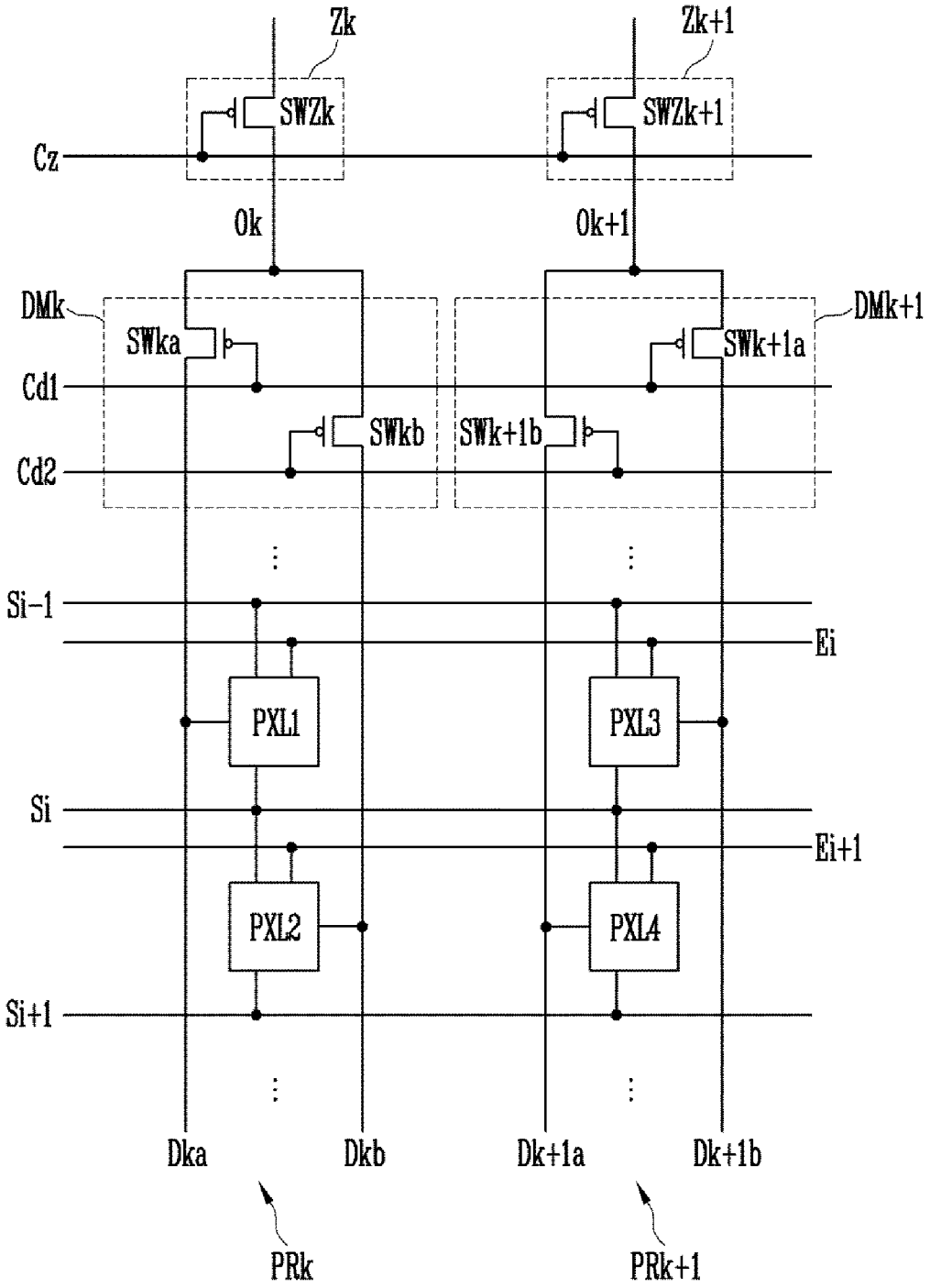

FIGS. 2A and 2B are circuit diagrams illustrating examples of coupling relationships between pixels and data lines, which are included in the display device of FIG. 1A. In FIGS. 2A and 2B, the display device 10 is illustrated based on a k-th (where k is a positive integer) signal transmission circuit Zk, a k-th signal distribution circuit DMk, and a k-th pixel column PRk, which are coupled to a k-th output line Ok for transmitting data signals output from the data driver 130 of FIG. 1A.

In FIG. 2A, a k+1-th signal transmission circuit Zk+1, a k+1-th signal distribution circuit DMk+1, and a k+1-th pixel column PRk+1, which are coupled to a k+1-th output line Ok+1, may be substantially identical to the k-th signal transmission circuit Zk, the k-th signal distribution circuit DMk, and the k-th pixel column PRk, respectively. Therefore, repeated descriptions thereof will be omitted.

Referring to FIGS. 1A and 2A, the k-th pixel column PRk may include a first pixel PXL1 and a second pixel PXL2. The first pixel PXL1 and the second pixel PXL2 may be repeatedly arranged in the k-th pixel column PRk.

The first pixel PXL1 may be coupled to a k-th odd-numbered data line Dka (hereinafter referred to as a "first data line"), and the second pixel PXL2 may be coupled to a k-th even-numbered data line Dkb (hereinafter referred to as a "second data line").

The first pixel PXL1 may emit light in a first color, and the second pixel PXL2 may emit light in a second color. For example, the first pixel PXL1 may emit light in red, and the second pixel PXL2 may emit light in blue.

A third pixel PXL3 and a fourth pixel PXL4 may emit light in a third color, or may emit light in, for example, green. However, the third pixel PXL3 and the fourth pixel PXL4 are not limited thereto, and they may emit light in different colors.

The k-th signal distribution circuit DMk may be coupled to the first data line Dka and the second data line Dkb.

The k-th signal distribution circuit DMk may include a first switching element SWka and a second switching element SWkb. The first switching element SWka and the second switching element SWkb may be implemented as transistors, and may be P-type transistors (e.g., PMOS transistors).

The first switching element SWka may be coupled between the k-th output line Ok and the first data line Dka, and may be turned on or off in response to a first driving signal Cd1. Similarly, the second switching element SWkb may be coupled between the k-th output line Ok and the second data line Dkb, and may be turned on or off in response to a second driving signal Cd2. Here, the first driving signal Cd1 and the second driving signal Cd2 may be included in the driving signal Cd, described above with reference to FIG. 1A. The first switching element SWka and the second switching element SWkb may be turned on during different periods, and these periods may not overlap each other.

The k-th signal transmission circuit Zk may be coupled to the k-th output line Ok and the k-th output terminal of the data driver 130.

The k-th signal transmission circuit Zk may include a third switching element SWZk (or an impedance switching element). The third switching element SWZk may be implemented as a PMOS transistor, but is not limited thereto.

The third switching element SWZk may be coupled to the k-th output line Ok and the k-th output terminal of the data driver 130, and may be turned on or off in response to the impedance control signal Cz.

In FIG. 2A, the arrangement of the k+1-th pixel column PRk+1 is illustrated as being identical to that of the k-th pixel column PRk, but the arrangement is not limited thereto. As illustrated in FIG. 2B, the arrangement of the k+1-th pixel column PRk+1 may be bilaterally symmetrical to that of the k-th pixel column PRk. For example, the third pixel PXL3 may be coupled to the k+1-th output line Ok+1 through the second data line Dk+1b and the first switching element SWk+1a, and the fourth pixel PXL4 may be coupled to the k+1-th output line Ok+1 through the first data line Dk+1a and the second switching element SWk+1b. That is, pixels included in a single pixel row need only be distributed and coupled to a pair of data lines, and the configuration of coupling between the pixels and the data lines is not particularly limited.

Figure 3:
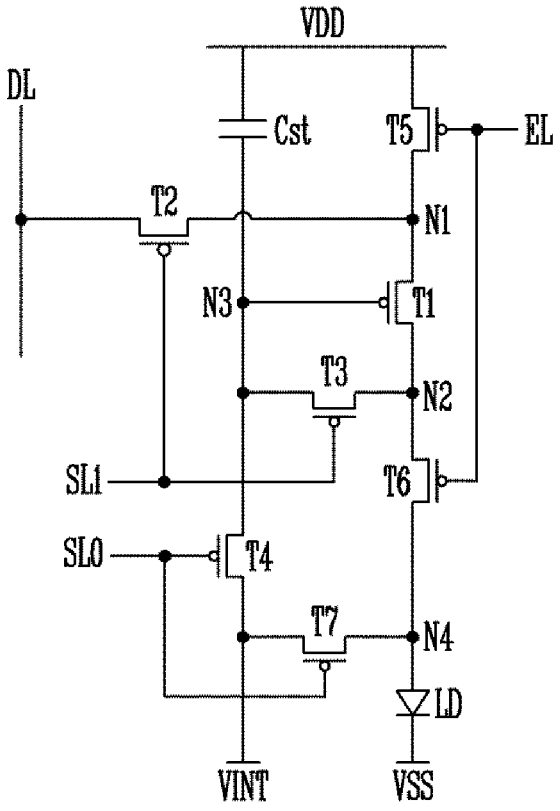
FIG. 3 is a circuit diagram illustrating an example of a pixel included in the display device of FIG. 1A.

FIG. 3 is a circuit diagram illustrating an example of a pixel included in the display device of FIG. 1A.

Referring to FIGS. 1A and 3, a pixel PXL may include first to seventh transistors T1 to T7, a storage capacitor Cst, and a light-emitting diode LD.

The first to seventh transistors T1 to T7 may be, but are not limited to, P-type transistors (e.g., PMOS transistors). For example, at least some of the first to seventh transistors T1 to T7 may be implemented as N-type transistors (e.g., NMOS transistors).

The first transistor T1 (or driving transistor) may include a first electrode electrically coupled to a first node N1, a second electrode electrically coupled to a second node N2, and a gate electrode electrically coupled to a third node N3.

The second transistor T2 may include a first electrode coupled to a data line DL, a second electrode coupled to the first node N1, and a gate electrode coupled to a first scan line SL1. The second transistor T2 may be turned on in response to a scan signal provided through the first scan line SL1, and may transfer a data signal provided through the data line DL to the first node N1. For example, the scan signal may be a pulse signal having a turn-on voltage level (or a logic low level) for turning on the corresponding transistor.

The third transistor T3 may include a first electrode coupled to the second node N2, a second electrode coupled to the third node N3, and a gate electrode coupled to the first scan line SL1. The third transistor T3 may be turned on in response to the scan signal, and may transfer the data signal, received from the first node N1 through the first transistor T1, to the third node N3.

The storage capacitor Cst may be coupled between a first supply voltage line and the third node N3. Here, a first supply voltage VDD may be applied to the first supply voltage line. The storage capacitor Cst may store the data signal transferred to the third node N3.

The fourth transistor T4 may include a first electrode coupled to the third node N3, a second electrode coupled to an initialization voltage line, and a gate electrode coupled to a previous scan line SL0. Here, the previous scan line SL0 may be a scan line arranged adjacent to the first scan line SL1. The fourth transistor T4 may be turned on in response to a previous scan signal provided through the previous scan line SL0, and may initialize the third node N3 using an initialization voltage VINT provided through the initialization voltage line. That is, the node voltage of the third node N3 (or the signal stored in the storage capacitor Cst in a previous frame) may be initialized to the initialization voltage VINT.

The fifth transistor T5 may include a first electrode coupled to the first supply voltage line (or the first supply voltage line to which the first supply voltage VDD is applied), a second electrode coupled to the first node N1, and a gate electrode coupled to an emission line EL. Similarly, a sixth transistor T6 may include a first electrode coupled to the second node N2, a second electrode coupled to a fourth node N4, and a gate electrode coupled to the emission line EL.

The fifth transistor T5 and the sixth transistor T6 may be turned on in response to an emission signal provided through the emission line EL, and may form a movement path for a driving current between the first supply voltage line and the fourth node N4 (or between the first supply voltage line and a second supply voltage line to which a second supply voltage VSS is applied).

The light-emitting diode LD may include an anode electrode coupled to the fourth node N4 and a cathode electrode coupled to the second supply voltage line. For example, the light-emitting diode LD may be an organic light-emitting diode or an inorganic light-emitting diode. The light-emitting diode LD may emit light with luminance corresponding to the driving current (or the amount of driving current).

The seventh transistor T7 may include a first electrode coupled to the fourth node N4, a second electrode coupled to the initialization voltage line, and a gate electrode coupled to the previous scan line SL0. The seventh transistor T7 may initialize the fourth node N4 (or parasitic capacitor of the light-emitting diode LD) in response to the previous scan signal.

Figure 4:
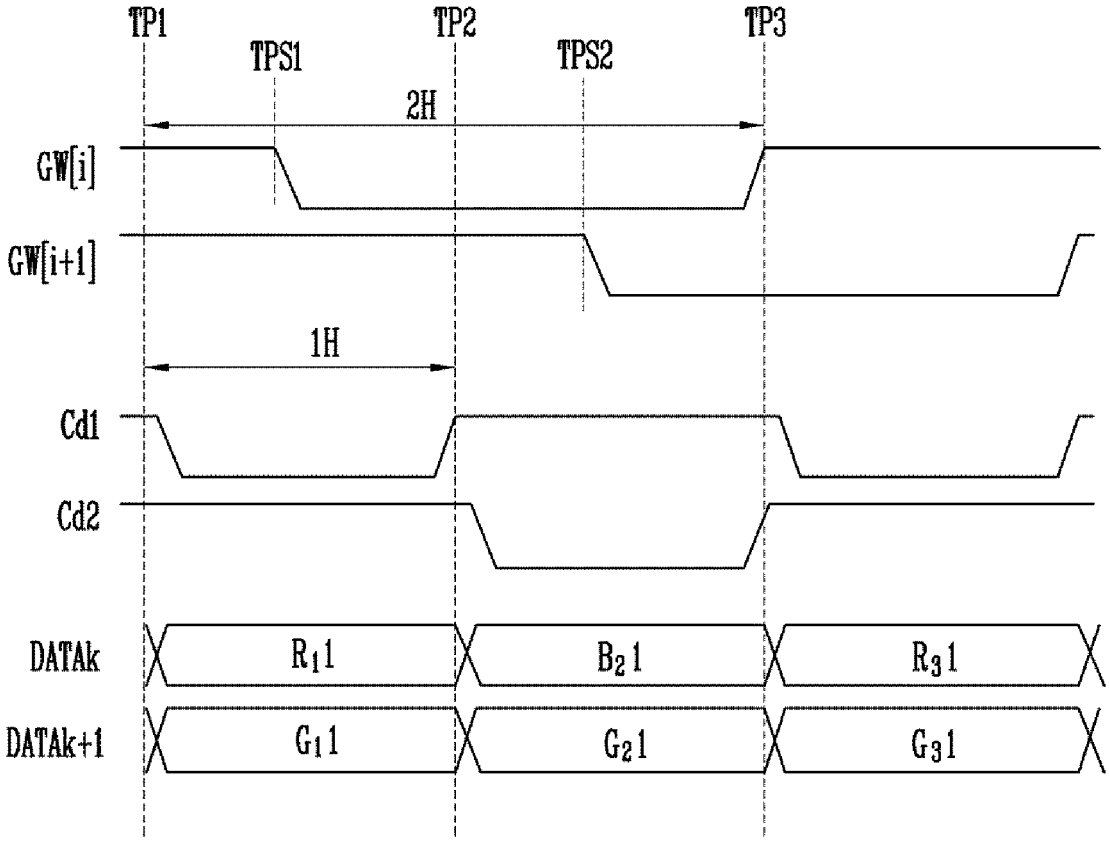
FIG. 4 is a waveform diagram for explaining the operation of the display device of FIG. 1A.

FIG. 4 is a waveform diagram for explaining the operation of the display device of FIG. 1A.

Referring to FIGS. 1A to 4, an i-th (where i is a positive integer) scan signal GW[i] may be a scan signal provided to an i-th scan line Si illustrated in FIG. 2A, and an i+1-th scan signal GW[i+1] may be a scan signal provided to an i+1-th scan line Si+1 illustrated in FIG. 2A.

A k-th data signal DATAk may be a data signal that is generated by, or output from, the data driver 130 illustrated in FIG. 1A in response to a k-th output line Ok (e.g., corresponding to a k-th pixel column PRk) illustrated in FIG. 2A. Similarly, a k+1-th data signal DATAk+1 may be a data signal that is generated by, or output from, the data driver 130 illustrated in FIG. 1A in response to a k+1-th output line Ok+1 (e.g., corresponding to a k+1-th pixel column PRk+1) illustrated in FIG. 2A.

At a first reference time point TP1, the k-th data signal DATAk may have a voltage level corresponding to a first grayscale value $R_1$1.

A first driving signal Cd1 may make a transition from a logic high level (or a turn-off voltage level) to a logic low level (or a turn-on voltage level) immediately or soon after the first reference time point TP1. In this case, the first switching element SWka of the k-th signal distribution circuit DMk illustrated in FIG. 2A may be turned on, and the data signal having the voltage level corresponding to the first grayscale value $R_1$1 may be provided to the first data line Dka illustrated in FIG. 2A.

Thereafter, at a first sub-time point TPS1, an i-th scan signal GW[i] may make a transition from a logic high level to a logic low level. In this case, the first and third transistors T1 and T3 (see FIG. 3) of the first pixel PXL1 illustrated in FIG. 2A may be turned on, and the data signal having the voltage level corresponding to the first grayscale value $R_1$1 may be stored in the storage capacitor Cst of the first pixel PXL1.

At a second reference time point TP2, the first driving signal Cd1 may make a transition from a logic low level to a logic high level. Here, the second reference time point TP2 may be a time point elapsed from, or following, the first reference time point TP1 by a one horizontal time (1H). In this case, the first switching element SWka of the k-th signal distribution circuit DMk illustrated in FIG. 2A may be turned off. However, the voltage level of the first data line Dka illustrated in FIG. 2A may be maintained at the voltage level corresponding to the first grayscale value $R_1$1. Also, because the first and third transistors T1 and T3 of the first pixel PXL1 remain turned on depending on the i-th scan signal GW[i] at a logic low level, writing of the k-th data signal DATAk to the first pixel PXL1 may be performed for a sufficient or suitable time.

At the second reference time point TP2, the k-th data signal DATAk may change to a voltage level corresponding to a second grayscale value $B_2$1.

A second driving signal Cd2 may make a transition from a logic high level to a logic low level immediately or soon after the second reference time point TP2. In this case, the second switching element SWkb of the k-th signal distribution circuit DMk illustrated in FIG. 2A may be turned on, and the data signal having the voltage level corresponding to the second grayscale value $B_2$1 may be provided to the second data line Dkb illustrated in FIG. 2A.

Thereafter, at a second sub-time point TPS2, an i+1-th scan signal GW[i+1] may make a transition from a logic high level to a logic low level. In this case, the first and third transistors T1 and T3 (see FIG. 3) of the second pixel PXL2 illustrated in FIG. 2A may be turned on, and the data signal having the voltage level corresponding to the second grayscale value $B_2$1 may be stored in the storage capacitor Cst of the second pixel PXL2.

At a third reference time point TP3, the second driving signal Cd2 may make a transition from a logic low level to a logic high level. In this case, the second switching element SWkb of the k-th signal distribution circuit DMk illustrated in FIG. 2A may be turned off. However, the voltage level of the second data line Dkb illustrated in FIG. 2A may be maintained at the voltage level corresponding to the second grayscale value $B_2$1, and the first and third transistors T1 and T3 of the second pixel PXL2 may remain turned on depending on the i+1-th scan signal GW[i+1] at a logic low level. Therefore, writing of the k-th data signal DATAk to the second pixel PXL2 may be performed for a sufficient time.

As described above with reference to FIG. 4, the k-th data signal DATAk is provided to the first and second pixels PXL1 and PXL2 (or pixels PXL) included in the k-th pixel column PRk (or the pixel column) through the k-th signal distribution circuit DMk (or the signal distributor DM) and the first and second data lines Dka and Dkb, thus enabling the k-th data signal DATAk to be written to the first and second pixels PXL1 and PXL2 for a sufficient time (e.g., 1.5 horizontal time). Even if one horizontal time (1H) is shortened due to the high-frequency driving of the display device 10, and even with an increase in the area of the display device 10, the display device 10 may accurately write data signals for a relatively sufficient time, and may display a desired image without deteriorating a display quality.

Figure 5:
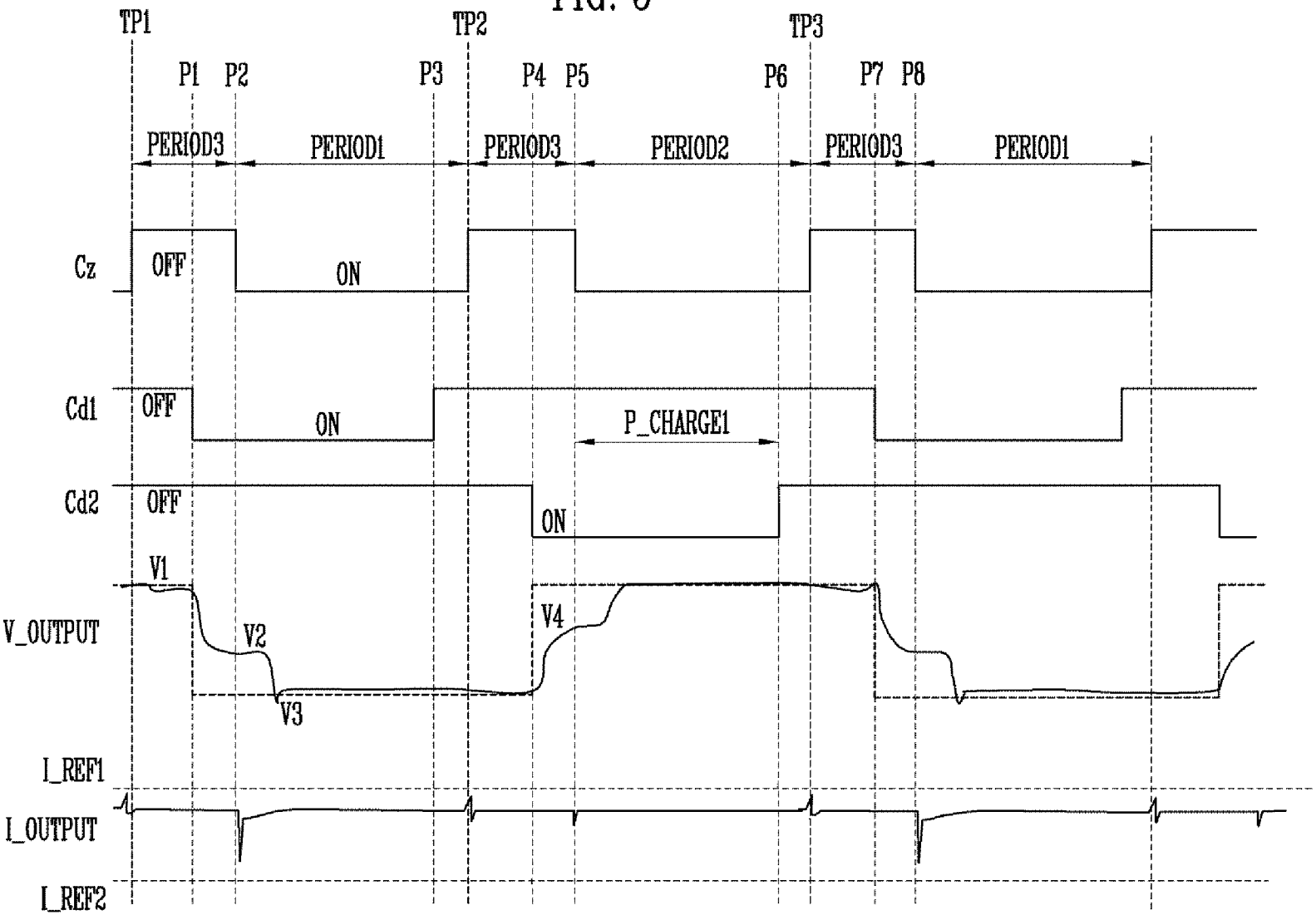
FIG. 5 is a waveform diagram illustrating examples of signals measured in the display device of FIG. 1A.
Figure 6A:
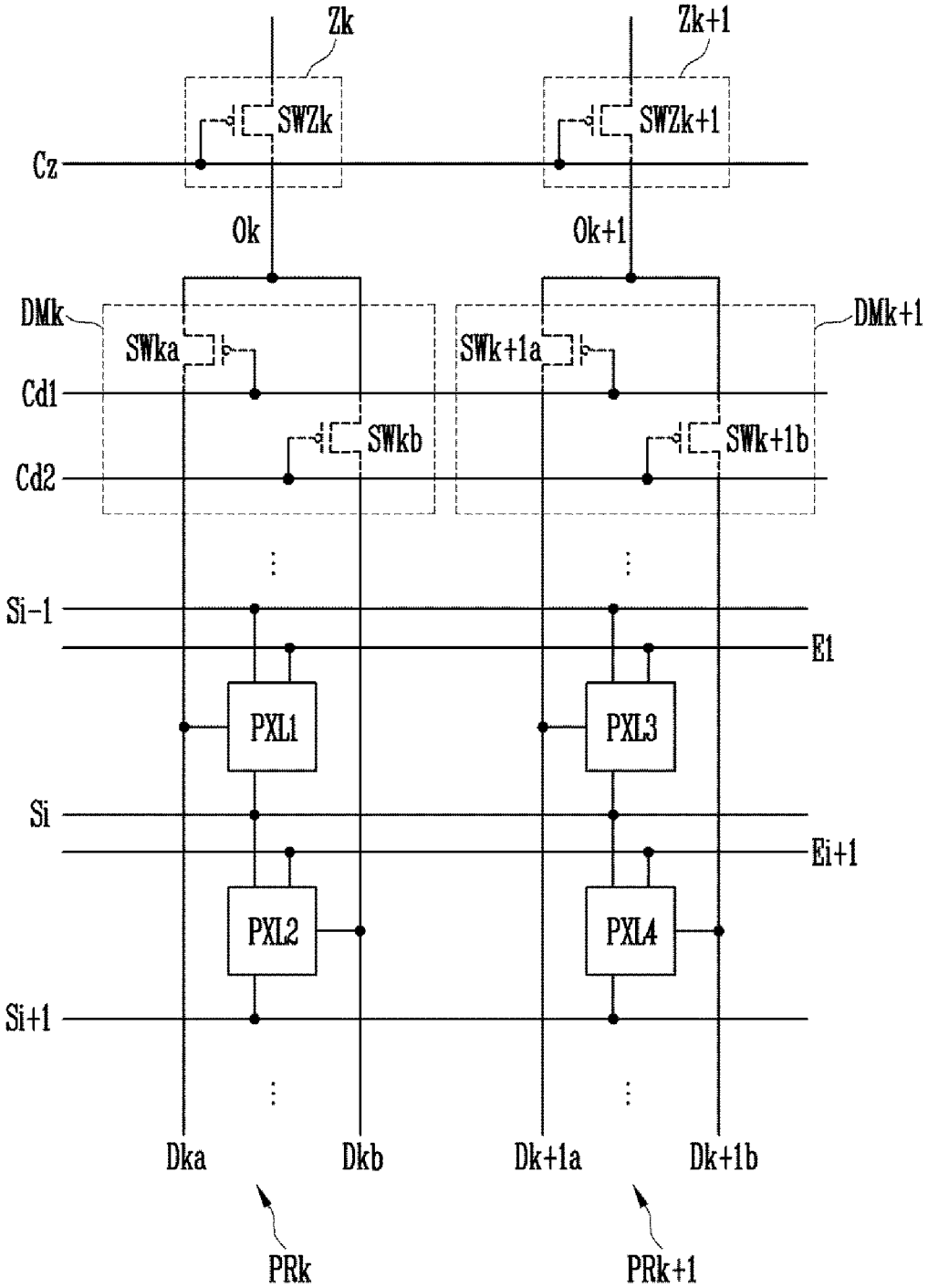
FIGS. 6A to 6C are diagrams for explaining the operation of the display device depending on the waveform diagram of FIG. 5.
Figure 6B:
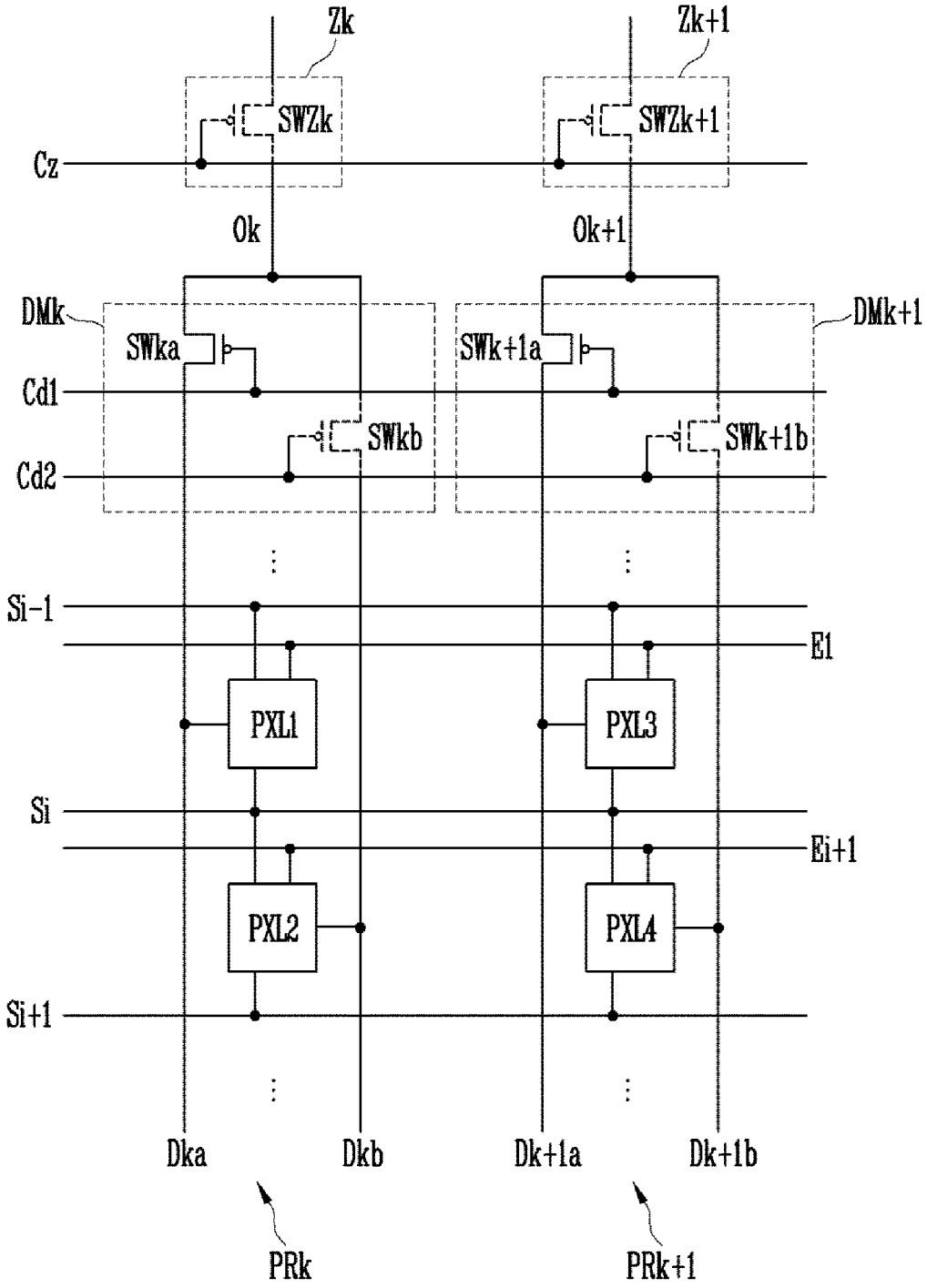
Figure 6C:
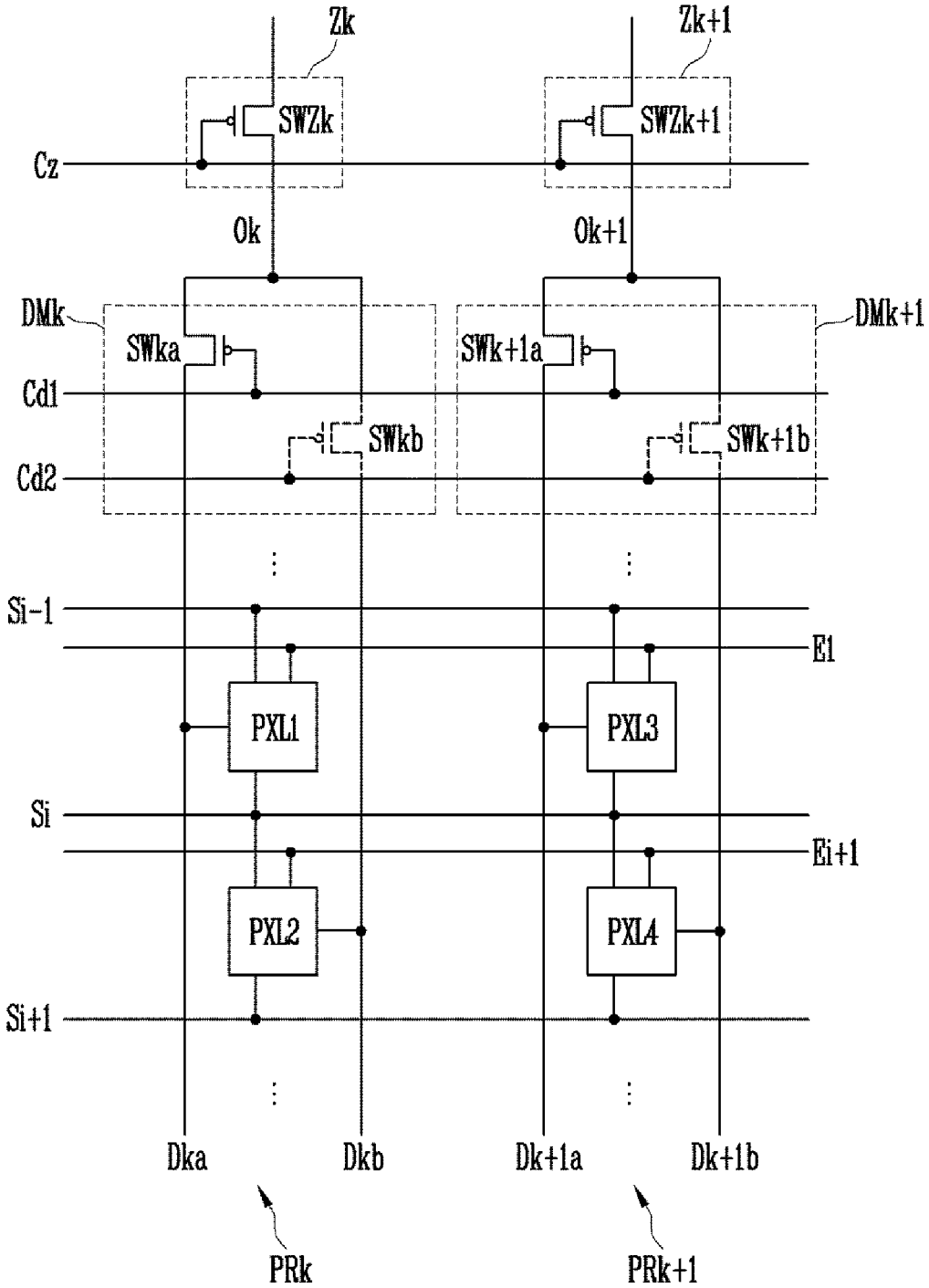

FIG. 5 is a waveform diagram illustrating examples of signals measured in the display device of FIG. 1A. FIGS. 6A to 6C are diagrams for explaining the operation of the display device depending on the waveform diagram of FIG. 5. In FIGS. 6A to 6C, pixels and data lines corresponding to pixels and data lines of FIG. 2A are illustrated.

Referring to FIGS. 1A and 4 to 6C, an impedance control signal Cz may have a logic high level (or a turn-off voltage level). As illustrated in FIG. 6A, the third switching element SWZk may remain turned off in response to the impedance control signal Cz at the logic high level. Therefore, impedance between the data driver 130 and the signal distribution circuit DMk may be in a relatively high state or, alternatively, the data driver 130 may be electrically disconnected from the signal distribution circuit DMk.

The first driving signal Cd1 and the second driving signal Cd2 may each have a logic high level. As illustrated in FIG. 6A, the first switching element SWka may be turned off in response to the first driving signal Cd1 at the logic high level, and the second switching element SWkb may be turned off in response to the second driving signal Cd2 at the logic high level.

Thereafter, at a first time point P1, the first driving signal Cd1 makes a transition from a logic high level to a logic low level (or a turn-on voltage level), and the first switching element SWka may be turned on in response to the first driving signal Cd1 at the logic low level, as illustrated in FIG. 6B. The second driving signal Cd2 may be maintained at a logic high level, and the second switching element SWkb may remain turned off in response to the second driving signal Cd2 at the logic high level. In this case, the input terminal of the signal distribution circuit DMk is electrically coupled to the first data line Dka, and a voltage V_OUTPUT at the input terminal of the signal distribution circuit DMk may vary due to a previous data signal applied in advance to the first data line Dka. For example, as illustrated in FIG. 5, the voltage V_OUTPUT at the input terminal of the signal distribution circuit DMk may vary from a first voltage level V1 to a second voltage level V2.

Meanwhile, an output current I_OUTPUT flowing through the output terminal of the data driver 130 may be hardly measured. The reason for this is that impedance between the data driver 130 and the signal distribution circuit DMk is in a relatively high state, or that the data driver 130 is electrically disconnected from the signal distribution circuit DMk.

Thereafter, at a second time point P2, the impedance control signal Cz may make a transition from a logic high level to a logic low level, and the third switching element SWZk illustrated in FIG. 6C may be turned on. Therefore, the data driver 130 may be electrically coupled to the signal distribution circuit DMk (or impedance between the data driver 130 and the signal distribution circuit DMk may become relatively low), and the data signal may be provided to the first data line Dka through the first switching element SWka of the signal distribution circuit DMk. For example, as illustrated in FIG. 5, the voltage V_OUTPUT at the input terminal of the signal distribution circuit DMk may sufficiently vary from the second voltage level V2 to a third voltage level V3 for a given amount of time.

In accordance with variation in the voltage V_OUTPUT at the input terminal of the signal distribution circuit DMk (e.g., to vary the voltage V_OUTPUT at the input terminal of the signal distribution circuit DMk), the transfer of charges between the data driver 130 and the signal distribution circuit DMk may occur, and thus the output current I_OUTPUT may be temporarily changed depending on the transfer of charges. For example, the output current I_OUTPUT may be changed within a range from a first reference current value I_REF1 to a second reference current value I_REF2 in accordance with a voltage difference between the first voltage level V1 and the third voltage level V3. The peak value of the output current I_OUTPUT may be equal to the first reference current value I_REF1.

For reference, the voltage difference between the third voltage level V3 and the second voltage level V2 may be relatively small. As described above with reference to FIG. 2A, the first data line Dka may be coupled to the first pixel PXL1 (e.g., pixels emitting light in a first color), and the first pixel PXL1 may have luminance that is relatively similar to that which it had in a previous frame, and thus a voltage difference between a data signal and a previous data signal may not be large.

Thereafter, at a third time point P3, the first driving signal Cd1 may make a transition from a logic low level to a logic high level. During a period between the second time point P2 and the third time point P3, the data signal may be applied to the first data line Dka through the first switching element SWka of the signal distribution circuit DMk.

Thereafter, at a second reference time point TP2, the impedance control signal Cz may make a transition from a logic low level to a logic high level. A period during which the impedance control signal Cz has a logic high level may be defined as a third period PERIOD3, and may be identical to a signal-blocking period described above with reference to FIG. 1A. Therefore, as illustrated in FIG. 6A, the third switching element SWZk may be turned off, and impedance between the data driver 130 and the signal distribution circuit DMk may become relatively high or, alternatively, the data driver 130 may be electrically disconnected from the signal distribution circuit DMk.

Meanwhile, a period between the second time point P2 and the second reference time point TP2, during which the impedance control signal Cz has a logic low level, may be defined as a first period PERIOD1, and may be included in a signal-transmission period, described above with reference to FIG. 1A.

At a fourth time point P4, the second driving signal Cd2 may make a transition from a logic high level to a logic low level, and the second switching element SWkb illustrated in FIG. 6A may be turned on in response to the second driving signal Cd2 at the logic low level. The first driving signal Cd1 may be maintained at a logic high level, and the first switching element SWka may remain turned off. In this case, the input terminal of the signal distribution circuit DMk may be electrically coupled to the second data line Dkb, and the voltage V_OUTPUT at the input terminal of the signal distribution circuit DMk may vary due to a previous data signal applied in advance to the second data line Dkb. For example, as illustrated in FIG. 5, the voltage V_OUTPUT at the input terminal of the signal distribution circuit DMk may vary from the third voltage level V3 to a fourth voltage level V4.

Meanwhile, the output current I_OUTPUT flowing through the output terminal of the data driver 130 may be hardly measured. The reason for this is that impedance between the data driver 130 and the signal distribution circuit DMk is in a relatively high state, or that the data driver 130 is electrically disconnected from the signal distribution circuit DMk.

Thereafter, at a fifth time point P5, the impedance control signal Cz may make a transition from a logic high level to a logic low level, and the third switching element SWZk illustrated in FIG. 6A may be turned on. Therefore, the data driver 130 may be electrically coupled to the signal distribution circuit DMk, the data signal may be provided to the second data line Dkb through the second switching element SWkb of the signal distribution circuit DMk, and the voltage V_OUTPUT at the input terminal of the signal distribution circuit DMk may sufficiently vary from the fourth voltage level V4 to the first voltage level V1 for a given amount of time, as illustrated in FIG. 5.

As described above, a voltage difference between the fourth voltage level V4 and the first voltage level V1 may be relatively small. As described above with reference to FIG. 2A, the second data line Dkb may be coupled to the second pixel PXL2 (e.g., pixels emitting light in a second color), and the second pixel PXL2 may have luminance relatively similar to that which it had in a previous frame, and thus a voltage difference between the data signal and the previous data signal may not be large.

In accordance with variation in the voltage V_OUTPUT at the input terminal of the signal distribution circuit DMk, the output current I_OUTPUT may temporarily change within a range from the first reference current value I_REF1 to the second reference current value I_REF2.

Thereafter, at a sixth time point P6, the second driving signal Cd2 may make a transition from a logic low level to a logic high level. During a period (e.g., a first writing period P_CHARGE1) between the fifth time point P5 and the sixth time point P6, the data signal may be applied to the second data line Dkb through the second switching element SWkb of the signal distribution circuit DMk.

The operations of the display device 10 at the third reference time point TP3, a seventh time point P7, and an eighth time point P8 may be substantially identical to those of the display device 10 at the first reference time point TP1, the first time point P1, and the second time point P2, respectively. Therefore, repeated descriptions thereof will be omitted.

As described above with reference to FIGS. 5 to 6C, a data signal is provided to the first data line Dka through the third switching element SWZk and the first switching element SWka illustrated in FIG. 2A during a part of the first period PERIOD1, and the data signal may be provided to the second data line Dkb through the third switching element SWZk and the second switching element SWkb illustrated in FIG. 2A during a part of the second period PERIOD2. Further, during the third period PERIOD3, the third switching element SWZk may be turned off, and thus impedance between the data driver 130 and the signal distribution circuit DMk may become relatively high or, alternatively, the data driver 130 may be electrically disconnected from the signal distribution circuit DMk. In this state, the input terminal of the signal distribution circuit DMk may be electrically coupled to the first data line Dka or the second data line Dkb, and may then be changed to have a given voltage level having a relatively small voltage difference with the data signal. Therefore, power consumption of the data driver 130 for changing the voltage level of the first data line Dka or the second data line Dkb to the voltage level of the data signal may be reduced.

Figure 7:
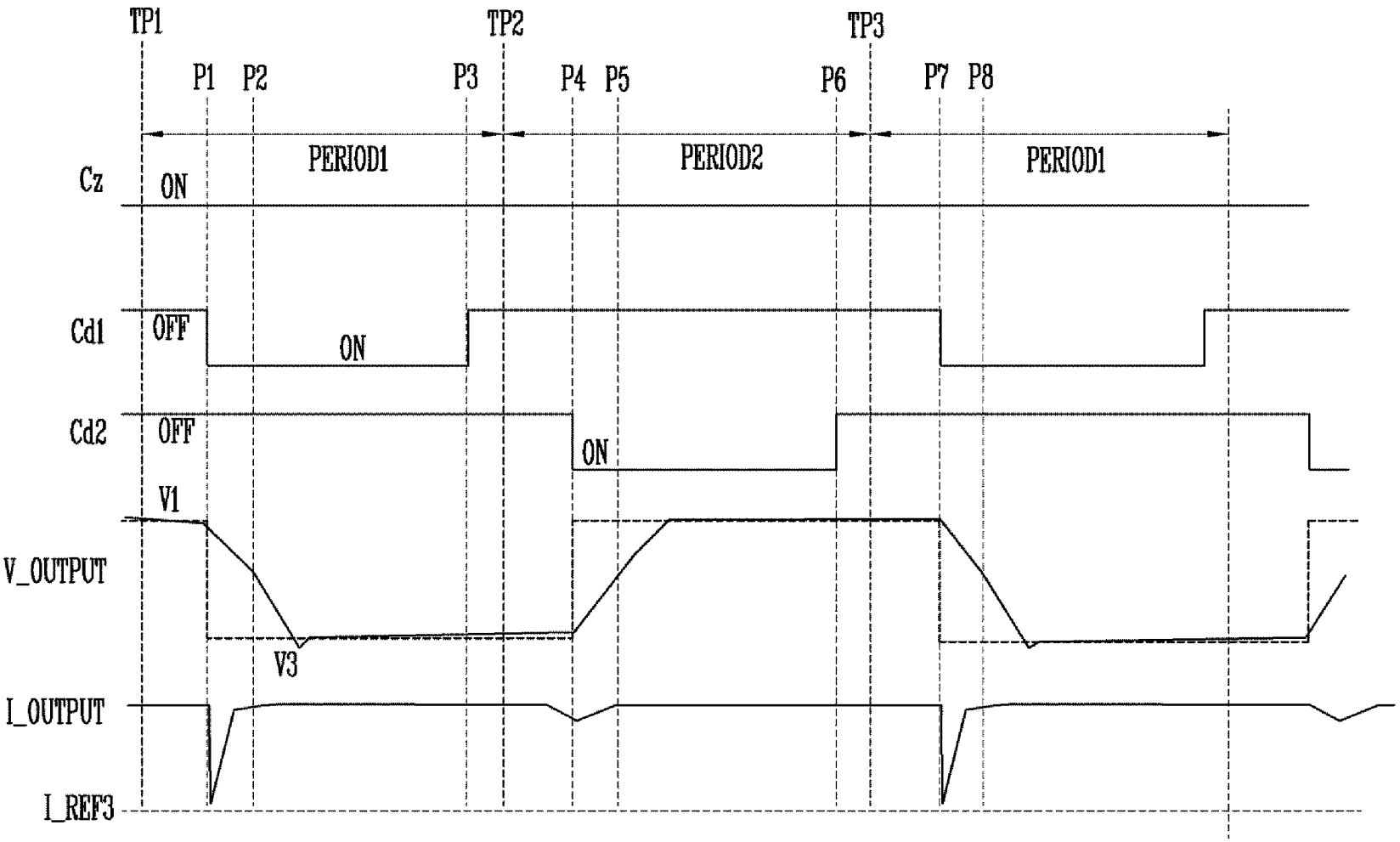
FIG. 7 is a waveform diagram illustrating comparative examples of signals measured in the display device of FIG. 1A.

FIG. 7 is a waveform diagram illustrating comparative examples of signals measured in the display device of FIG. 1A. Because a first driving signal Cd1 and a second driving signal Cd2 illustrated in FIG. 7 are substantially identical to the first driving signal Cd1 and the second driving signal Cd2 described above with reference to FIG. 5, a repeated description thereof will be omitted.

An impedance control signal Cz may have a logic low level (or a turn-on voltage level) during the entire period. Therefore, the third switching element SWZk of FIG. 2A may remain turned on, and the data driver 130 and the signal distribution circuit DMk may remain electrically coupled to each other.

At a first time point P1, when the first switching element SWka is turned on in response to the first driving signal Cd1 at a logic low level, a data signal may be provided to the first data line Dka through the first switching element SWka.

A voltage V_OUTPUT at the input terminal of the signal distribution circuit DMk may vary from a first voltage level V1, which is that of a previous data signal, to a third voltage level V3, which is that of a current data signal.

In accordance with variation in the voltage V_OUTPUT at the input terminal of the signal distribution circuit DMk, the transfer of charges between the data driver 130 and the signal distribution circuit DMk may occur, and thus an output current I_OUTPUT may be temporarily changed depending on the transfer of charges. For example, the output current I_OUTPUT may be changed within a range from a first reference current value to a third reference current value I_REF3 in accordance with a voltage difference between the first voltage level V1 and the third voltage level V3. Here, the third reference current value I_REF3 may be about twice a first reference current value depending on the voltage difference between the first voltage level V1 and the third voltage level V3. Therefore, power consumption of the data driver 130 of the present embodiment may be increased to about twice that of the data driver 130 described above with reference to FIG. 5.

Similarly, at a fourth time point P4, when the second switching element SWkb is turned on in response to the second driving signal Cd2 at a logic low level, the data signal may be provided to the second data line Dkb through the second switching element SWkb.

The voltage V_OUTPUT at the input terminal of the signal distribution circuit DMk may vary from the third voltage level V3, which is that of a previous data signal, to the first voltage level V1, which is that of a current data signal.

In accordance with variation in the voltage V_OUTPUT at the input terminal of the signal distribution circuit DMk, the transfer of charges between the data driver 130 and the signal distribution circuit DMk may occur, and thus the output current I_OUTPUT may be temporarily changed depending on the transfer of charges. For example, the output current I_OUTPUT may be changed within the range of the third reference current value I_REF3 in accordance with a voltage difference between the first voltage level V1 and the third voltage level V3.

As described above with reference to FIG. 7, when the signal distribution circuit DMk performs a switchover (or a switching) operation in a state in which the output terminal of the data driver 130 is electrically coupled to the input terminal of the signal distribution circuit DMk, power consumption of the data driver 130 may relatively increase.

Figure 8A:
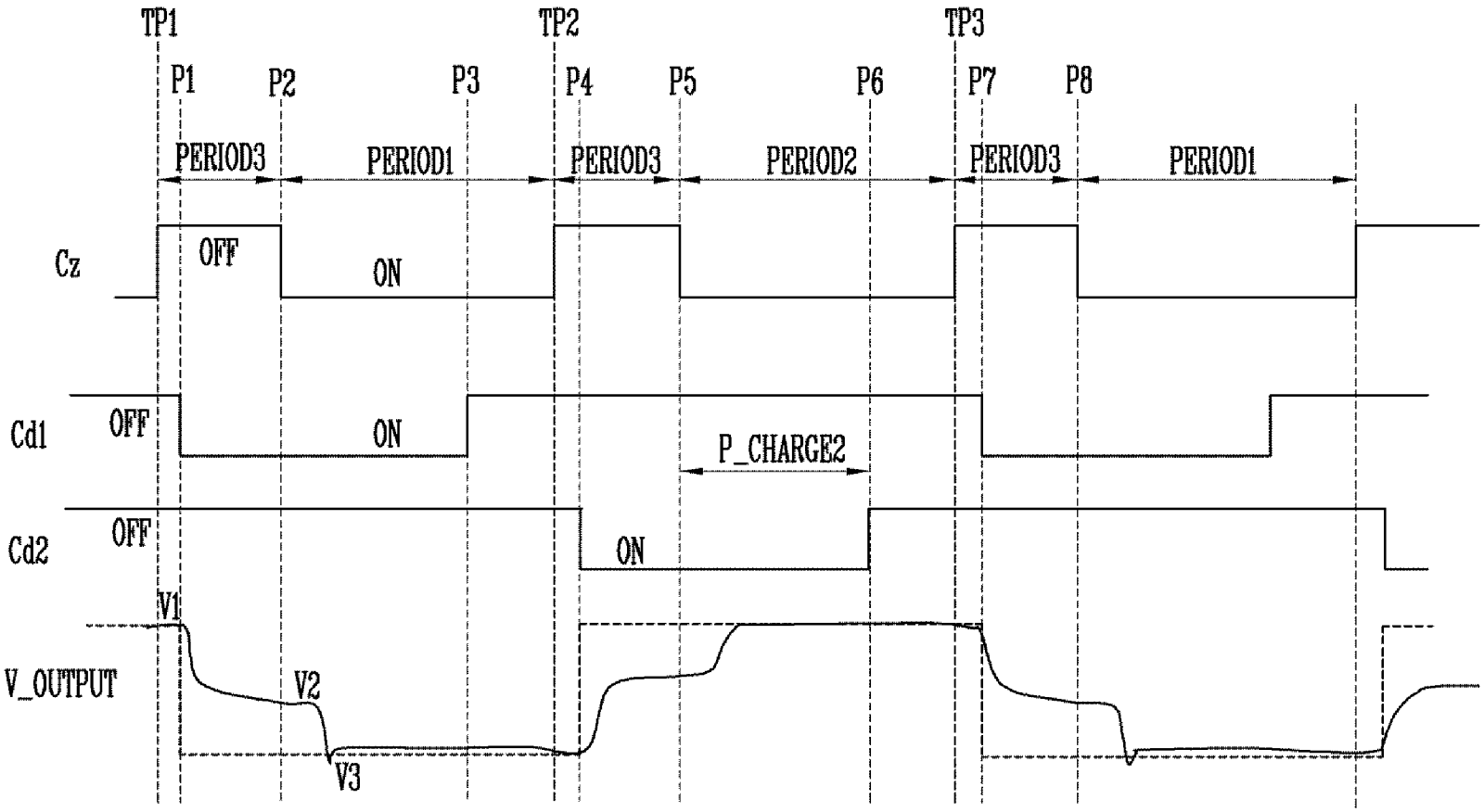
FIG. 8A is a waveform diagram illustrating examples of signals measured in the display device of FIG. 1A.
Figure 8B:
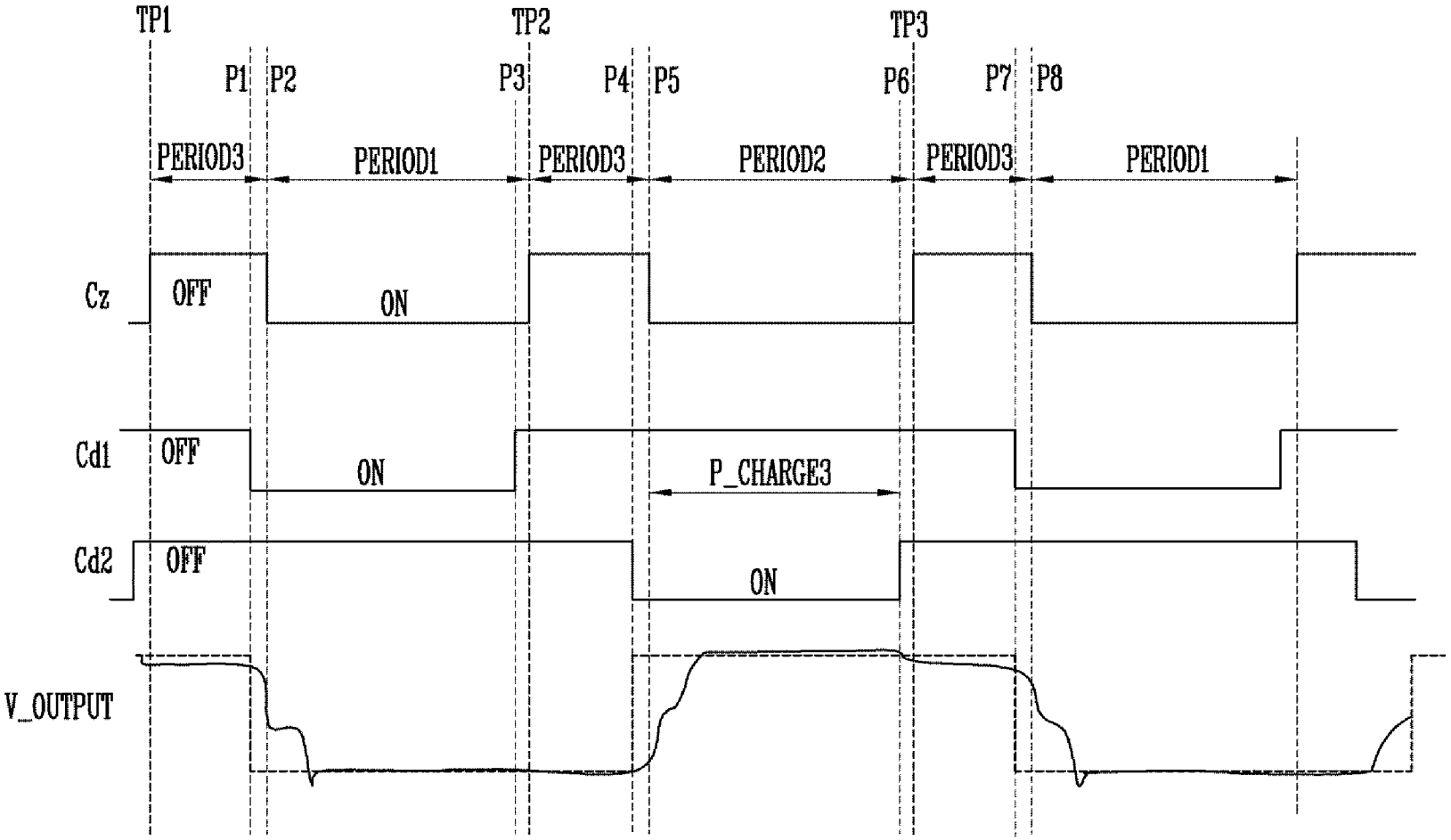
FIG. 8B is a waveform diagram illustrating examples of signals measured in the display device of FIG. 1A.

FIG. 8A is a waveform diagram illustrating examples of signals measured in the display device of FIG. 1A. FIG. 8B is a waveform diagram illustrating examples of signals measured in the display device of FIG. 1A. In FIGS. 8A and 8B, waveform diagrams corresponding to FIG. 5 are illustrated.

Referring to FIGS. 5 and 8A, the general operations of the display device 10 at first to eighth time points P1 to P8 of FIG. 8A may be substantially identical to those of the display device 10 at the first to eighth time points P1 to P8 of FIG. 5, respectively. Thus, repeated descriptions thereof will be omitted.

Based on first to third reference time points TP1 to TP3, the first to eighth time points P1 to P8 of FIG. 8A may appear earlier than the first to eighth time points P1 to P8 of FIG. 5.

The time point P1 at which the first driving signal Cd1 makes a transition from a logic high level to a logic low level may be closer to a start point of the third period PERIOD3 than to an end point of the third period PERIOD3. For example, immediately or soon after the third switching element SWZk is turned off, and then impedance between the data driver 130 and the signal distribution circuit DMk is increased (or immediately or soon after the data driver 130 is electrically disconnected from the signal distribution circuit DMk), the first switching element SWka may be turned on.

Similarly, the fourth time point P4 at which the second driving signal Cd2 makes a transition from a logic high level to a logic low level may be closer to the start point of the third period PERIOD3 than to the end point of the third period PERIOD3. For example, immediately or soon after the third switching element SWZk is turned off, and then impedance between the data driver 130 and the signal distribution circuit DMk is increased (or immediately or soon after the data driver 130 is electrically disconnected from the signal distribution circuit DMk), the second switching element SWkb may be turned on.

Here, the voltage V_OUTPUT at the input terminal of the signal distribution circuit DMk may vary for a more sufficient time due to a previous data signal applied in advance to the first data line Dka or the second data line Dkb, and power consumption of the data driver 130 may be further reduced. However, a second writing period P_CHARGE2 during which the data signal is applied to the second data line Dkb (or the first data line Dka) may be shorter than the first writing period P_CHARGE1 described above with reference to FIG. 5.

Referring to FIGS. 5 and 8B, the general operations of the display device 10 at first to eighth time points P1 to P8 of FIG. 8B may be substantially identical to those of the display device 10 at the first to eighth time points P1 to P8 of FIG. 5, respectively. Thus, repeated descriptions thereof will be omitted.

Based on first to third reference time points TP1 to TP3, the first to eighth time points P1 to P8 of FIG. 8B may appear later than the first to eighth time points P1 to P8 of FIG. 5.

The first time point P1 at which the first driving signal Cd1 makes a transition from a logic high level to a logic low level may be closer to an end point of the third period PERIOD3 than to a start point of the third period PERIOD3. For example, immediately or shortly before the third switching element SWZk is turned on, the first switching element SWka may be turned on.

Similarly, the fourth time point P4 at which the second driving signal Cd2 makes a transition from a logic high level to a logic low level may be closer to the end point of the third period PERIOD3 than to the start point of the third period PERIOD3. For example, immediately or shortly before the third switching element SWZk is turned on, the second switching element SWkb may be turned on.

In this case, a time during which the voltage V_OUTPUT at the input terminal of the signal distribution circuit DMk varies may be further shortened due to a previous data signal applied in advance to the first data line Dka or the second data line Dkb. However, a third writing period P_CHARGE3 during which the data signal is applied to the second data line Dkb (or the first data line Dka) may become longer than the first writing period P_CHARGE1, described above with reference to FIG. 5.

In an embodiment, the fourth time point P4 at which the second driving signal Cd2 makes a transition from a logic high level to a logic low level may be identical to the end point of the third period PERIOD3. Due to the transmission delay of the data signal from the data driver 130, the transmission delay of the impedance control signal Cz, and the response speed of the third switching element SWZk, the voltage V_OUTPUT at the input terminal of the signal distribution circuit DMk may primarily vary due to the previous data signal applied in advance to the second data line Dkb, and may secondarily vary due to the data signal provided to the second data line Dkb. Even in this case, power consumption of the display device 10 (or the data driver 130) may be reduced compared to a display device not equipped with the signal transmission circuit Zk (or the third switching element SWZk).

As described above with reference to FIGS. 8A and 8B, power consumption of the data driver 130 may be further reduced, or a period during which data signals are to be transmitted to the data lines Dka and Dkb may be sufficiently secured, by controlling a turn-on time point of the first switching element SWka (e.g., the first time point P1), and by controlling a turn-on time point of the second switching element SWkb (e.g., the fourth time point P4) during the third period PERIOD3.

Figure 9:
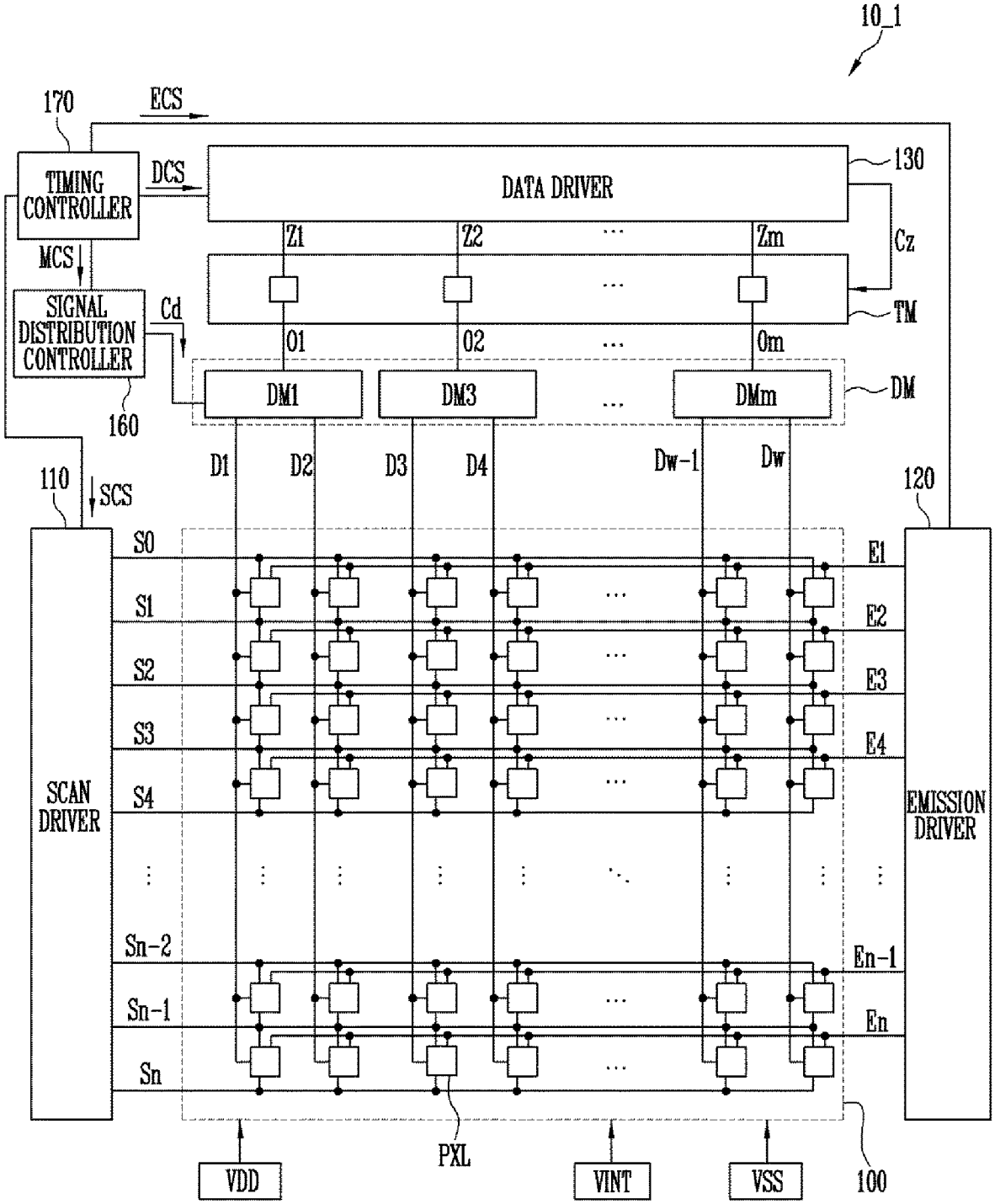
FIG. 9 is a block diagram illustrating a display device according to an embodiment of the present disclosure.

FIG. 9 is a block diagram illustrating a display device according to an embodiment of the present disclosure.

Referring to FIGS. 1A and 9, a display device 10_1 may include a display panel 100, a scan driver 110, an emission driver 120, a data driver 130, a signal distributor (demultiplexer) DM, a signal transmitter TM, a signal distribution controller 160, and a timing controller 170.

Because the scan driver 110, the emission driver 120, the data driver 130, the signal distribution controller 160, and the timing controller 170, which are illustrated in FIG. 9, are substantially the same as the scan driver 110, the emission driver 120, the data driver 130, the signal distribution controller 160, and the timing controller 170, respectively, which are described above with reference to FIG. 1A, repeated descriptions thereof will be omitted.

The display panel 100 may be substantially the same as the display panel 100, described above with reference to FIG. 1A, except for data lines D1 to Dw.

The display panel 100 may include pixels PXL, and pixels PXL included in a single pixel column may be coupled to a single data line.

The data driver 130 may generate data signals based on image data provided from the timing controller 170, and may output the data signals through output terminals (or to output lines O1 to Om, where m is a positive integer).

The data driver 130 may alternately generate data signals corresponding to the pixels included in two pixel columns, and may sequentially output the data signals through output terminals corresponding to the two pixel columns. For example, the data driver 130 may generate data signals corresponding to pixels included in a first pixel column and a second pixel column, and may output the data signals to the first output terminal (e.g., the first output line O1). Although the data driver 130 has been described as generating data signals corresponding to two pixel columns in FIG. 9, the data driver 130 is not limited thereto. For example, the data driver 130 may generate data signals corresponding to three or four pixel columns, and may then output the data signals through a single output terminal.

The signal distributor DM may receive the data signals through the input terminals (or output lines O1 to Om), and may distribute the data signals to the data lines D1 to Dw in response to a driving signal Cd.

The signal distributor DM may include signal distribution circuits DM1 to DMm. Each of the signal distribution circuits DM1 to DMm may be coupled to a pair of data lines. For example, the first signal distribution circuit DM1 may be coupled to a first data line D1 and a second data line D2. In this case, the first signal distribution circuit DM1 may alternately transmit data signals, received through the first input terminal (or the first output line O1), to the first data line D1 and the second data line D2.

Similarly, the m-th signal distribution circuit DMm may be coupled to a w−1-th data line Dw−1 and a w-th data line Dw, and may alternately transmit the data signals received through the m-th input terminal (or the m-th output line Om) to the w−1-th data line Dw−1 and the w-th data line Dw.

The signal transmitter TM may be coupled between the output terminals of the data driver 130 and the input terminals of the signal distributor DM, and may transmit the data signals from the data driver 130 to the signal distributor DM, or may block the transmission of the data signals in response to the impedance control signal Cz.

In embodiments, the signal transmitter TM may transmit data signals to the signal distributor DM during signal-transmission intervals (or signal-transmission periods), and may block the transmission of data signals during a signal-blocking interval (or a signal-blocking period). For example, during the signal-blocking period, the signal transmitter TM may increase impedance between the signal transmitter TM and the signal distributor DM, or may electrically disconnect (or isolate) the signal transmitter TM from the signal distributor DM.

The signal transmitter TM may include signal transmission circuits Z1 to Zm. Each of the signal transmission circuits Z1 to Zm may be coupled to one of the output terminals of the data driver 130 and to one of the input terminals of the signal distributor DM. For example, the first signal transmission circuit Z1 may be coupled to the first output terminal of the data driver 130, and may be coupled to the first input terminal (or the first signal distribution circuit DM1) of the signal distributor DM through the first output line O1. Similarly, the m-th signal transmission circuit Zm may be coupled to the m-th output terminal of the data driver 130, and may be coupled to the m-th input terminal (or the m-th signal distribution circuit DMm) of the signal distributor DM through the m-th output line Om.

Figure 10:
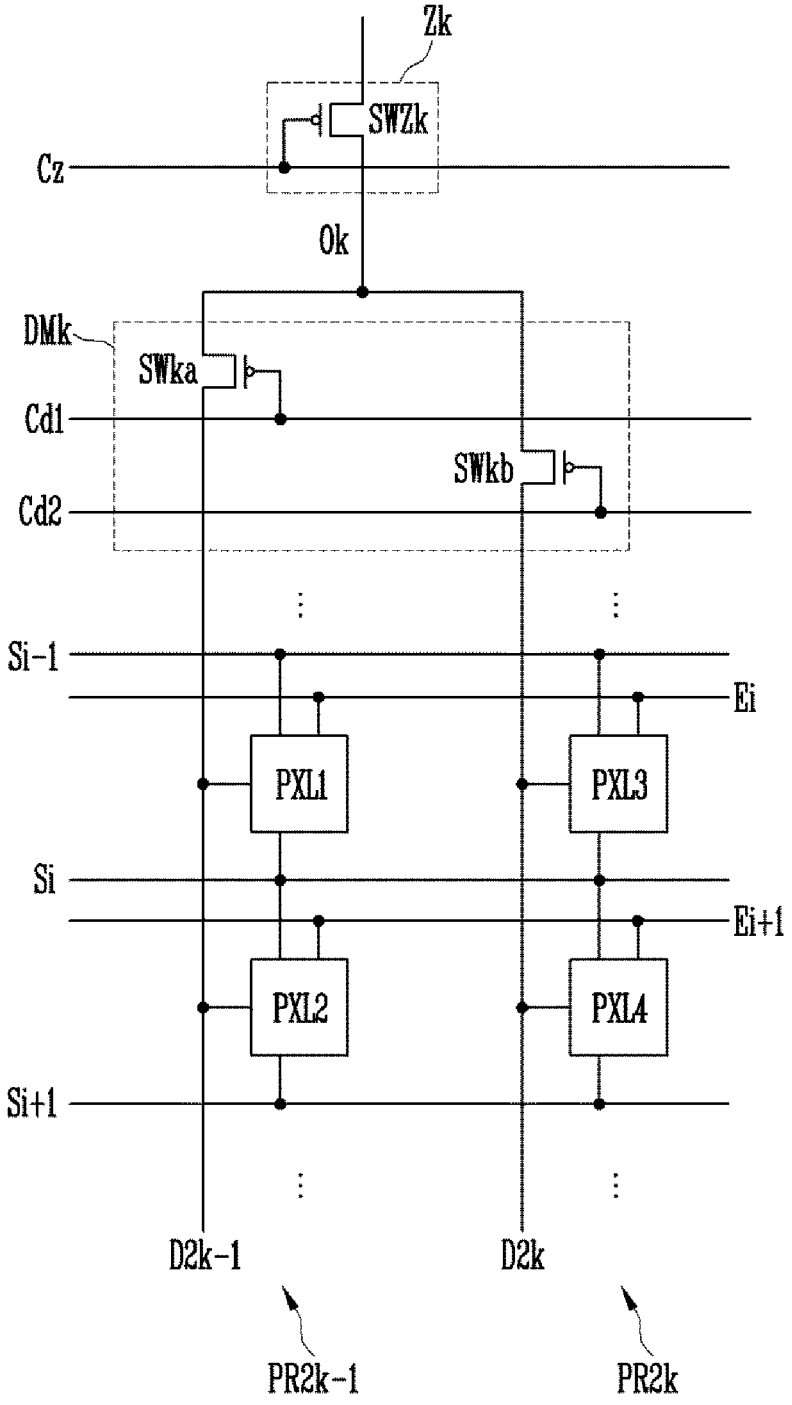
FIG. 10 is a diagram illustrating an example of coupling relationships between pixels and data lines included in the display device of FIG. 9.

FIG. 10 is a diagram illustrating an example of coupling relationships between pixels and data lines included in the display device of FIG. 9. In FIG. 10, the display device 10_1 is illustrated based on a k-th signal transmission circuit Zk (where k is a positive integer), a k-th signal distribution circuit DMk, and 2k−1-th and 2k-th pixel columns PR2*k*−1 and PR2*k*, which are coupled to a k-th output line Ok that transmits the data signals output from the data driver 130 of FIG. 9.

Referring to FIGS. 9 and 10, the 2k−1-th pixel column PR2*k*−1 may include a first pixel PXL1 and a second pixel PXL2 coupled to a 2k−1-th data line D2*k*−1 (hereinafter referred to as a "first data line"). The first pixel PXL1 and the second pixel PXL2 may be repeatedly arranged in the 2k−1-th pixel column PR2*k*−1. Here, the first pixel PXL1 may emit light in a first color (e.g., red), and the second pixel PXL2 may emit light in a second color (e.g., blue).

Similarly, the 2k-th pixel column PR2*k* may include a third pixel PXL3 and a fourth pixel PXL4 coupled to a 2k-th data line D2*k* (hereinafter referred to as a "second data line"). The third pixel PXL3 and the fourth pixel PXL4 may be repeatedly arranged in the 2k-th pixel column PR2*k*. Here, the third pixel PXL3 and the fourth pixel PXL4 may emit light in a third color (e.g., green), but are not limited thereto.

The k-th signal distribution circuit DMk may be coupled to the first data line D2*k*−1 and the second data line D2*k*.

The k-th signal distribution circuit DMk may include a first switching element SWka and a second switching element SWkb. The first switching element SWka and the second switching element SWkb may be implemented as transistors, and may be P-type transistors (e.g., PMOS transistors).

The first switching element SWka may be coupled between the k-th output line Ok and the first data line D2*k*-1, and may be turned on or off in response to a first driving signal Cd1. Similarly, the second switching element SWkb may be coupled between the k-th output line Ok and the second data line D2*k*, and may be turned on or off in response to a second driving signal Cd2. The first switching element SWka and the second switching element SWkb may be turned on during different periods, which may not overlap each other.

The k-th signal transmission circuit Zk may be coupled to the k-th output line Ok and the k-th output terminal of the data driver 130. The k-th signal transmission circuit Zk may include a third switching element SWZk. The third switching element SWZk may be implemented as a transistor.

The third switching element SWZk may be coupled to the k-th output line Ok and the k-th output terminal of the data driver 130, and may be turned on or off in response to an impedance control signal Cz.

Meanwhile, each of the pixels PXL1 to PXL4 may have a pixel structure, such as that described above with reference to FIG. 3, but each is not limited thereto.

Figure 11:
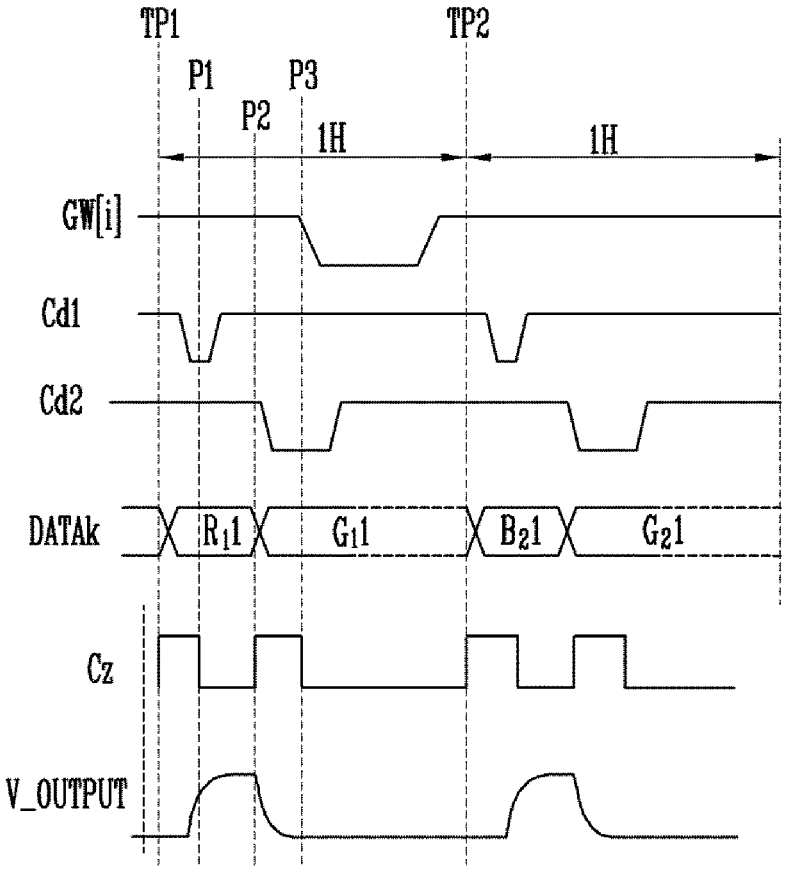
FIG. 11 is a waveform diagram for explaining the operation of the display device of FIG. 9.

FIG. 11 is a waveform diagram for explaining the operation of the display device of FIG. 9.

Referring to FIGS. 9 to 11, an i-th (where i is a positive integer) scan signal GW[i] may be a scan signal provided to an i-th scan line Si illustrated in FIG. 10.

A data signal DATAk may be a data signal output from the data driver 130 of FIG. 9 in accordance with the k-th output line Ok of FIG. 10.

At a first reference time point TP1, the data signal DATAk may have a voltage level corresponding to a first grayscale value $R_1$1.

Each of the first driving signal Cd1, the second driving signal Cd2, and the impedance control signal Cz may have a logic high level (or a turn-off voltage level). Therefore, each of the first switching element SWka, the second switching element SWkb, and the third switching element SWZk, which are illustrated in FIG. 10, may be in a turn-off state.

Thereafter, immediately or soon after the first reference time point TP1 (or immediately or shortly before a first time point P1), the first driving signal Cd1 may make a transition from a logic high level to a logic low level (or to a turn-on voltage level). In this case, the first switching element SWka of FIG. 10 may be turned on. The input terminal of the signal distribution circuit DMk may be electrically coupled to the first data line D2*k*−1, and a voltage V_OUTPUT at the input terminal of the signal distribution circuit DMk may vary due to a previous data signal applied in advance to the first data line D2*k*−1.

Meanwhile, because the third switching element SWZk is in a turn-off state, impedance between the data driver 130 and the signal distribution circuit DMk may be relatively high or, alternatively, the data driver 130 may be electrically disconnected from the signal distribution circuit DMk. Therefore, an output current hardly flows through the output terminal of the data driver 130.

Thereafter, at the first time point P1, the impedance control signal Cz makes a transition from a logic high level to a logic low level, and the third switching element SWZk of FIG. 10 may be turned on. Therefore, the data driver 130 may be electrically coupled to the signal distribution circuit DMk (or impedance between the data driver 130 and the signal distribution circuit DMk becomes relatively low), the data signal may be provided to the first data line D2*k*−1 through the first switching element SWka of the signal distribution circuit DMk, and the voltage V_OUTPUT at the input terminal of the signal distribution circuit DMk may sufficiently vary to have a voltage level corresponding to a first grayscale value $R_1$1 for a given amount of time.

Thereafter, immediately or shortly before a second time point P2, the first driving signal Cd1 may make a transition from a logic low level to a logic high level.

At the second time point P2, the impedance control signal Cz may make a transition from a logic low level to a logic high level. Therefore, the third switching element SWZk of FIG. 10 may be turned off, and impedance between the data driver 130 and the signal distribution circuit DMk may become relatively high or, alternatively, the data driver 130 may be electrically disconnected from the signal distribution circuit DMk.

Immediately or soon after the second time point P2 (or before a third time point P3), the second driving signal Cd2 may make a transition from a logic high level to a logic low level. In this case, the second switching element SWkb of FIG. 10 may be turned on. The input terminal of the signal distribution circuit DMk may be electrically coupled to the second data line D2*k*, and the voltage V_OUTPUT at the input terminal of the signal distribution circuit DMk may vary due to a previous data signal applied in advance to the second data line D2*k*.

Thereafter, at the third time point P3, the impedance control signal Cz may make a transition from a logic high level to a logic low level, and the third switching element SWZk of FIG. 10 may be turned on. Therefore, the data driver 130 may be electrically coupled to the signal distribution circuit DMk, the data signal may be provided to the second data line D2*k* through the second switching element SWkb of the signal distribution circuit DMk, and the voltage V_OUTPUT at the input terminal of the signal distribution circuit DMk may sufficiently vary to have a voltage level corresponding to a second grayscale value Gil for a given amount of time.

After the third time point P3, an i-th scan signal GW[i] may make a transition from a logic high level to a logic low level, and thus a data signal having a voltage level corresponding to the first grayscale value $R_1$1 and a data signal having a voltage level corresponding to the second grayscale value Gil may be respectively written to the first pixel PXL1 and the third pixel PXL3 of FIG. 10.

The operation of the display device 10_1 at the second reference time point TP2 may be substantially the same as that of the display device 10_1 at the first reference time point TP1. The second reference time point TP2 may be a time point elapsed from the first reference time point TP1 by one horizontal time (1H), and the display device 10_1 may be operated using the one horizontal time (1H) as a period.

As described above with reference to FIGS. 9 to 11, while the data signal DATAk is not applied to the data lines D2*k*−1 and D2*k*, the third switching element SWZk may be turned off, and thus impedance between the data driver 130 and the signal distribution circuit DMk may become relatively high or, alternatively, the data driver 130 may be electrically disconnected from the signal distribution circuit DMk. While the third switching element SWZk is turned off, the input terminal of the signal distribution circuit DMk may be electrically coupled to the first data line D2*k*−1 or the second data line D2*k*, and may then be changed to have a given voltage level having a relatively small voltage difference with the data signal. Therefore, power consumption of the data driver 130, which changes the voltage level of the first data line D2$k$−1 or the second data line D2$k$ to the voltage level of the data signal, may be reduced.

Meanwhile, relationships between the first driving signal Cd1, the second driving signal Cd2, and the impedance control signal Cz, described above with reference to FIGS. 8A and 8B, may be applied to the display device 10_1 of FIG. 9.

Figure 12:
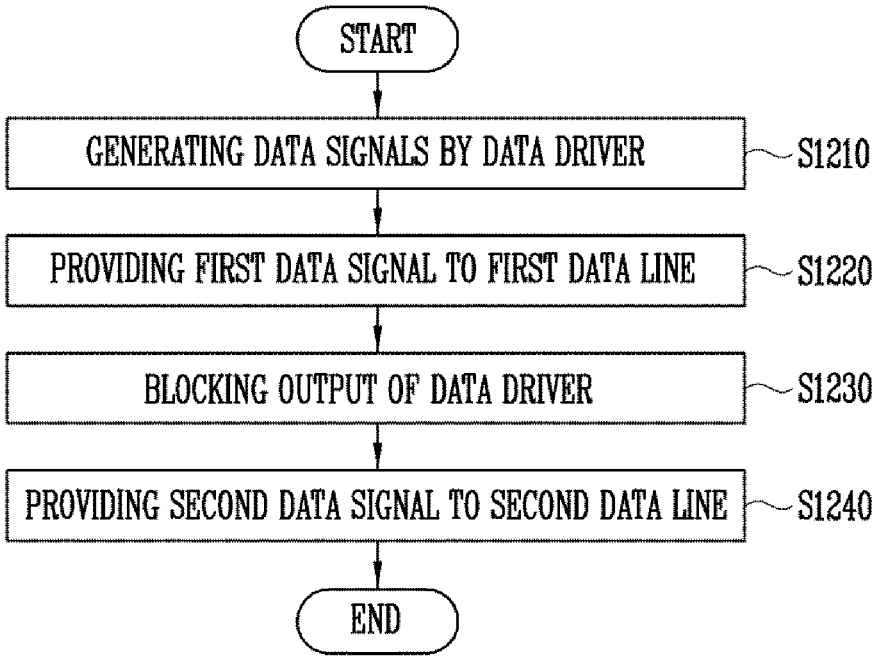
FIG. 12 is a flowchart illustrating a method of driving a display device according to an embodiment of the present disclosure.

FIG. 12 is a flowchart illustrating a method of driving a display device according to an embodiment of the present disclosure.

Referring to FIGS. 1A, 9, and 12, the method of FIG. 12 may be performed by the display device 10 of FIG. 1A or the display device 10_1 of FIG. 9. Hereinafter, a description will be made on the assumption that the method of FIG. 12 is performed by the display device 10 of FIG. 1A.

In the method of FIG. 12, data signals for a first pixel PXL1 and a second pixel PXL2 (see FIG. 2A) in the display panel 100 may be sequentially generated by the data driver 130 at step S1210.

In the method of FIG. 12, a first data signal among the data signals may be provided to a first data line Dka coupled to the first pixel PXL1 through the signal distribution circuit DMk (see FIG. 2A) at step S1220.

For example, during the first period PERIOD1 described above with reference to FIG. 5, the method of FIG. 12 may provide the first data signal to the first data line Dka.

Thereafter, in the method of FIG. 12, the output of the data driver 130 to the signal distribution circuit DMk may be blocked at step S1230.

As described above with reference to FIG. 2A, the method of FIG. 12 may increase impedance between the data driver 130 and the signal distribution circuit DMk through the signal transmission circuit Zk coupled between the data driver 130 and the signal distribution circuit DMk, or may electrically disconnect the data driver 130 from the signal distribution circuit DMk.

For example, during the third period PERIOD3 (e.g., the third period PERIOD3 between the second reference time point TP2 and the fifth time point P5) described above with reference to FIG. 5, the method of FIG. 12 may block the output of the data driver 130 to the signal distribution circuit DMk.

Thereafter, in the method of FIG. 12, a second data signal among the data signals may be provided to a second data line Dkb coupled to the second pixel PXL2 through the signal distribution circuit DMk (see FIG. 2A) at step S1240.

For example, during the second period PERIOD2 described above with reference to FIG. 5, the method of FIG. 12 may provide the second data signal to the second data line Dkb.

As described above with reference to FIG. 12, the method of driving the display device may electrically couple the input terminal of the signal distribution circuit DMk to the first data line Dka or the second data line Dkb in a state in which the impedance between the data driver 130 and the signal distribution circuit DMk is increased or in which the data driver 130 is electrically disconnected from the signal distribution circuit DMk, thus reducing power consumption of the data driver 130 which changes the voltage level of the first data line Dka or the second data line Dkb to the voltage level of the data signal.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims, with functional equivalents thereof to be included therein.

What is claimed is:

1. A display device, comprising:

a display panel comprising a pixel column having a first pixel and a second pixel, a first data line coupled to the first pixel, and a second data line coupled to the second pixel;

a data driver configured to output a data signal for the pixel column to an output line;

a signal distribution circuit configured to receive the data signal through the output line, and to alternately transmit the data signal to the first data line and to the second data line; and a signal transmission circuit coupled between the data driver and the output line, and configured to transmit the data signal to the output line during a first period and a second period, and to block transmission of the data signal during a third period that is between the first period and the second period, wherein the signal distribution circuit comprises a first switching element coupled between the output line and the first data line, and a second switching element coupled between the output line and the second data line, and wherein, in a state in which the first switching element and the second switching element are turned off, the signal transmission circuit starts blocking transmission of the data signal.

2. The display device according to claim 1, wherein the signal distribution circuit couples the output line to one of the first data line and the second data line during the third period, and wherein a remaining one of the first data line and the second data line is disconnected from the output line during the third period.

3. The display device according to claim 2, wherein the signal distribution circuit is configured to transmit the data signal to the first data line during the first period, and to transmit the data signal to the second data line during the second period.

4. The display device according to claim 1, wherein one of the first switching element and the second switching element is turned on during the third period, and wherein a remaining one of the first switching element and the second switching element remains turned off during the third period.

5. The display device according to claim 4, wherein the remaining one of the first switching element and the second switching element is turned off during the first period, and wherein the first period is a period previous to the third period.

6. The display device according to claim 5, wherein, after the remaining one of the first switching element and the second switching element has been turned off, the one of the first switching element and the second switching element is turned on.

7. The display device according to claim 5, wherein the signal transmission circuit comprises a third switching element coupled between the data driver and the output line, and wherein the third switching element is turned off at a start point of the third period, and is turned on at an end point of the third period, in response to an impedance control signal provided from the data driver.

8. The display device according to claim 7, wherein a time point at which the one of the first switching element and the second switching element is turned on is closer to the start point of the third period than to the end point of the third period.

9. The display device according to claim 7, wherein a time point at which the one of the first switching element and the second switching element is turned on is closer to the end point of the third period than to the start point of the third period.

10. The display device according to claim 1, wherein the second pixel is adjacent to the first pixel, wherein the first pixel is configured to emit light in a first color, wherein the second pixel is configured to emit light in a second color that is different from the first color, and wherein the first pixel and the second pixel are alternately and repeatedly arranged in the pixel column.

11. A method of driving a display device, comprising:

generating, by a data driver, a data signal for a first pixel and a second pixel in a display panel;

providing the data signal to a first data line coupled to the first pixel through a signal distribution circuit;

blocking an output of the data driver to the signal distribution circuit; and providing the data signal to a second data line coupled to the second pixel through the signal distribution circuit, wherein the signal distribution circuit comprises a first switching element coupled between an output line and the first data line, and a second switching element coupled between the output line and the second data line, and wherein, in a state in which the first switching element and the second switching element are turned off, blocking the output of the data driver is started.

12. The method according to claim 11, wherein the first pixel and the second pixel are in a single pixel column, wherein the second pixel is adjacent to the first pixel, wherein the first pixel emits light in a first color, and wherein the second pixel emits light in a second color that is different from the first color.

13. The method according to claim 12, wherein blocking the output of the data driver comprises increasing an impedance between the data driver and the signal distribution circuit through a signal transmission circuit coupled between the data driver and the signal distribution circuit.

14. The method according to claim 13, wherein the signal transmission circuit comprises a third switching element coupled between the data driver and the output line, and wherein providing the data signal to the first data line comprises:

turning on the first switching element in a state in which the second switching element is turned off; and turning on the third switching element.

15. The method according to claim 14, wherein blocking the output of the data driver comprises turning off the third switching element.

16. The method according to claim 15, wherein the third switching element is turned off after turning off the first switching element.

17. The method according to claim 14, wherein a time point at which the first switching element is turned on is closer to a time point at which the third switching element is turned off than to a time point at which the third switching element is turned on.

18. The method according to claim 14, wherein a time point at which the first switching element is turned on is closer to a time point at which the third switching element is turned on than to a time point at which the third switching element is turned off.

19. The method according to claim 11, wherein the first pixel and the second pixel are in a single pixel row.

20. The method according to claim 19, wherein a third switching element is coupled between the data driver and the output line, and wherein providing the data signal to the first data line comprises:

turning on the first switching element in a state in which the second switching element is turned off; and turning on the third switching element.

* * * * *